United States Patent [19]

Spiewak et al.

[11] Patent Number: 4,988,597

[45] Date of Patent: Jan. 29, 1991

[54] CONDUCTIVE AND BLOCKING LAYERS FOR ELECTROPHOTOGRAPHIC IMAGING MEMBERS

[75] Inventors: John W. Spiewak, Webster; Huoy-Jen Yuh, Pittsford; Constance J. Thornton, Ontario; Dennis A. Abramsohn, Pittsford; Deborah Nichol-Landry, Rochester; Joseph Mammino, Penfield, all of N.Y.

[73] Assignee: Xerox Corporation, Stamford, Conn.

[21] Appl. No.: 458,875

[22] Filed: Dec. 29, 1989

[51] Int. Cl.[5] ..... G03G 5/10

[52] U.S. Cl. ..... 430/62; 430/64; 252/500

[58] Field of Search ..... 430/62, 64; 252/500

[56] References Cited

U.S. PATENT DOCUMENTS

| | | | |
|---|---|---|---|
| 3,113,022 | 12/1963 | Cassiers et al. | 430/31 |
| 3,245,833 | 4/1966 | Trevoy | 430/31 |
| 3,295,967 | 1/1967 | Schoenfeld | 96/1.5 |
| 3,428,451 | 2/1969 | Trevoy | 430/31 |
| 3,554,742 | 1/1971 | Gramza | 430/63 |
| 3,640,708 | 2/1972 | Humphries et al. | 96/1.5 |
| 3,745,005 | 7/1973 | Yaeger et al. | 96/1.5 |
| 3,932,179 | 1/1976 | Perez-Albuerne | 96/15 |
| 4,082,551 | 4/1978 | Steklenski et al. | 96/1 PC |
| 4,262,053 | 4/1981 | Burwasser | 428/327 |
| 4,410,614 | 10/1983 | Lelental et al. | 430/45 |
| 4,464,450 | 8/1984 | Truscher | 430/59 |
| 4,465,751 | 8/1984 | Kawamura et al. | 430/64 |
| 4,485,161 | 11/1984 | Scozzafava et al. | 430/64 |
| 4,584,253 | 4/1986 | Lin et al. | 430/59 |

OTHER PUBLICATIONS

Koji Abe, Mikio-Koide & Eichum Tcuhida, Macromolecules 10/61 1259-1264 (1977).

M. M. Coleman and D. J. Skrovanek, Conference Proceeding of 44th ANTEC, 321-322 (1986).

*Primary Examiner*—David Welsh

*Attorney, Agent, or Firm*—Peter H. Kondo

[57] ABSTRACT

An electrophotographic imaging member including a supporting substrate, an electrically conductive layer including at least a partially crosslinked polymer having a backbone derived from an alkyl acrylamidoglycolate alkyl ether, a charge blocking layer including a polymer having a backbone also derived from an alkyl acrylamidoglycolate alkyl ether and at least one photoconductive layer. Preferably, the backbone derived from an alkyl acrylamidoglycolate alkyl ether is a copolymer of methyl acrylamidoglycolate methyl ether and a vinyl hydroxy ester or vinyl hydroxy amide. This imaging member may be prepared by a coating process and employed in an electrostatographic imaging process.

20 Claims, No Drawings

CONDUCTIVE AND BLOCKING LAYERS FOR ELECTROPHOTOGRAPHIC IMAGING MEMBERS

BACKGROUND OF THE INVENTION

This invention relates in general to electrostatography and, more specifically, to a novel photoconductive device and process for using the device.

In the art of xerography, a xerographic plate containing a photoconductive insulating layer is imaged by first uniformly electrostatically charging its surface. The plate is then exposed to a pattern of activating electromagnetic radiation which selectively dissipates the charge in the illuminated areas of the photoconductive insulator while leaving behind an electrostatic charge pattern in the nonilluminated areas. This resulting electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer sandwiched between the contiguous charge transport layer and a supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the anode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers (CGL) and charge transport layers (CTL) have been investigated. For example, the photosensitive member described in U.S. Pat. No. 4,265,990 utilizes a charge generating layer in contiguous contact with a charge transport layer comprising a polycarbonate resin and one or more of certain diamine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed, for example, in U.S. Pat. No. 4,265,990. Additional examples of binder materials such as poly(hydroxyether) resins are taught in U.S. Pat. No. 4,439,507. The disclosures of the aforesaid U.S. Pat. Nos. 4,265,990 and 4,439,507 are incorporated herein in their entirety. Photosensitive members having at least two electrically operative layers as disclosed above provide excellent images when charged with a uniform negative electrostatic charge, exposed to a light image and thereafter developed with finely divided electroscopic marking particles. However, when the supporting conductive substrate comprises a charge injecting metal or non-metal, difficulties have been encountered with these photosensitive members due to discharge in the dark. More specifically, these photosensitive members do not retain sufficient charge during the charging and subsequent imaging exposure and development steps. Most metallic ground planes have a natural oxide layer which inhibits charge injection. Typical metals of this type are aluminum, zirconium, titanium and the like. Some exceptions are metals that do not oxidize such as the noble metals, e.g., gold, platinum and the like that promote charge injection. Ground planes containing other materials such as copper iodide or carbon black also inject charge into charge generation layers so the photoreceptor does not effectively hold charge during the charging, image exposure and/or development steps. Copper iodide ground planes as disclosed in, for example, U.S. Pat. No. 4,082,551 encounter degradation problems during cycling.

When ground planes contain conductive particles dispersed in a resin binder, difficulties can be encountered with migration of the resin binder and/or conductive particles into subsequently applied layers that contain solvents which at least partially dissolve or swell the resin binder in the conductive layer. Such migration of the resin binder or conductive particles can adversely affect the integrity of the ground plane and the electrical properties of the ground plane and/or the subsequently applied layers. More specifically, polymers in the binders utilized for ground planes can migrate into the charge generating layer and cause charge trapping. When charge trapping occurs during cycling, internal fields build up and background prints out in the final printed copies. Further, conductive particles can move up to subsequently applied layers and prevent the photoreceptor from receiving a full electrostatic charge in the areas where the conductive material migrated. For example, migration of conductive particles such as carbon black into subsequently applied layers causes lower charge acceptance and perhaps $V_R$ cycle-up. The regions of lower charge acceptance appear as white spots in the final printed copy. Solvent attack can also cause discontinuities in the ground plane resulting in nonuniform charging which ultimately causes the formation of distorted images in the final toner image. Cross-linking of the resin binder in the ground plane reduces solubility. However, existing methods of cross-linking polymers such as hydroxylic polymers, although chemically efficient in the cross-linking process itself, leave much to be desired in applications for photoreceptors because of catalytic or process residues which can permanently reside in the photoreceptor. Such residues, even at the parts per million level, are very often deleterious to one or more of the sensitive electrical properties required for superior photoreceptor performance. Moreover cross-linking mechanisms often require an additional heating step which can result in the evolution of a volatile matter and residue formation. Also, cross linking capability may require an externally added low molecular weight cross-linking agent, which may not be totally consumed and may in part migrate to other layers in the photoreceptor. Also the addition of cross-linking materials or catalysts can adversely affect electrical and physical properties of the ground plane.

Charge blocking layers are frequently used on metalized or other kinds of ground planes to inhibit charge injection. Some charge blocking layers require an additional adhesive layer between the charge generation layer and the conductive ground plane. When attempts are made to use resins as a blocking layer, the photoreceptors usually exhibit increased residual charge with cycling. A catalyst is usually used to form polymers or to cross-link polymers employed in blocking layer applications. Catalytic residue present is undesirable and cause electrical problems such as charge trapping which increases residual charge with cycling ultimately leading to background deposit build up. The polymers utilized in blocking layers can mix with materials in subsequently applied layers due to sensitivity to solvents used in the subsequently applied layers. This mixing of polymers from the blocking layers with subsequently applied layers can cause the blocking layer to lose its effectiveness as a blocking function and the photoreceptor becomes unusable for forming images. Failure to effectively hold charge during the image exposure and development steps or increased residual charge formation with cycling cannot normally be tolerated in precision copiers, duplicators, and printers.

Copolymers of methyl vinyl ether and maleic anhydride such as the Gantrez AN resins from GAF Corporation have been utilized in blocking layers. Unfortunately, these copolymers of methyl vinyl ether and maleic anhydride are sensitive to water and rapidly hydrolyze to form acidic products which are corrosive and attack metal ground planes of photoreceptors during electrical cycling. Loss of the ground plane due to corrosion during electrical cycling eventually prevents an electrophotographic imaging member from discharging. This is manifested by an increase in background toner deposits in the final image during electrical cycling. In addition, the mechanical properties of copolymers of methyl vinyl ether and maleic anhydride are affected at high humidity and cause flexible electrophotographic imaging members to delaminate. Under low humidity conditions, blocking layers containing copolymers of methyl vinyl ether and maleic anhydride or maleic anhydride tend to cause electrical surface potential cycle down. Cycle down affects the final copy by causing loss of electrical contrast between exposed and unexposed areas. In addition, copolymers of methyl vinyl ether and maleic anhydride are sensitive to certain solvents utilized in subsequently applied layers and redissolve and lose integrity as a blocking layer. Hydrolysis of copolymers of methyl vinyl ether and maleic anhydride transforms the anhydride to the acid. The acid formed during storage will attack the metallic conductive layer and result in photoreceptors that will no longer discharge. Moreover, during cycling, corrosion of thin metal ground planes is accelerated and this will also result in photoreceptors that will no longer discharge. Also, when the acid is formed, coating with the material is generally restricted to coating with water and low molecular weight alcohols.

When some resins are employed in blocking layers, difficulties can be encountered with migration of the resin into subsequently applied layers that contain solvents which at least partially dissolve or swell the resin in the blocking layer. Such migration of the resin can adversely affect the integrity and the electrical properties of the blocking layer and/or the subsequently applied layers. Cross-linking of the resin in the blocking layer reduces solubility but an additional heating step to effect cross-linking may be necessary. Also the addition of cross-linking materials or catalysts may be required and these additives can adversely affect electrical and physical properties of the blocking layer.

Poly(vinylalcohol) (PVOH) has been evaluated for use as a blocking layer. However, aqueous solutions of this material are very viscous and difficult to apply as a coating. For example, very dilute but still viscous poly(-vinylalcohol) aqueous solutions require numerous spray coating passes to build up blocking layer dry thickness to the desired level. Moreover, the solvents that may be employed for poly(vinylalcohol) are not conducive to the formation of high quality coatings. In addition, the adhesion of poly(vinylalcohol) to many conductive layer polymers is poor.

INFORMATION DISCLOSURE STATEMENT

U.S. Pat. No. 3,932,179 issued to E. A. Perez-Albuerne on Jan. 13, 1976—A multilayer electrophotographic element is disclosed comprising a conducting layer, a photoconductive layer, and a polymeric interlayer having a surface resistivity greater than about $10^{12}$ ohm/sq between the conducting layer and the photoconductive layer. The interlayer comprises a blend of at least two distinct polymeric phases comprising: (a) a film forming water or alkali-water soluble polymer and (b) an electrically insulating, film forming, hydrophobic polymer. For example, the conducting layer may contain cuprous iodide imbibed in a copolymeric binder of polymethylmethacrylate and polymethacrylic acid. A complex two phase hazy layer, composed of a complex terpolymer (65 wt. percent) of poly(methylacrylate-vinylidene chloride-itaconic acid) and polyvinylmethylether maleic anhydride) (35 wt. percent) is employed as an organic solvent barrier, an adhesive aid, and a hole blocking layer. The film forming water or alkali-water soluble polymer may contain pendant side chains composed of groups such as acidic, hydroxy, alkoxy and ester groups.

U.S. Pat. No. 4,082,551 issued to Steklenski et al on Apr. 4, 1978—A unitary photoconductive element is disclosed having an electrically conducting layer, a photoconductive layer thereon, and a multilayer interlayer composition interposed between the conducting layer and the photoconductive layer. The multilayer interlayer composition comprises a layer containing an acidic polymer material, a layer containing a basic polymer material, and an acid-base reaction product zone formed at the interface of the acidic polymer-containing layer and the basic polymer-containing layer. The basic polymer materials appear to be basic because of the presence of amine groups. Various basic amino methacrylate and acrylate monomers and polymers are disclosed. Thus, for example, the complex barrier bilayer adjacent to a CuI conductive layer may be composed of an acrylic or methacrylic acid copolymer and the top layer composed of a poly 2-vinylpyridine-polymethylmethacrylate copolymer such that a salt interlayer forms at the interface of these acidic and basic polymers. The multilayer interlayer composition provides good adhesion between the conducting and photoconductive layers of the resultant unitary element and can function as an electrical barrier blocking positive charge carriers which might otherwise be injected into the photoconductive layer from the underlying conducting layer.

U.S. Pat. No. 4,584,253 issued to Lin et al on Apr. 22, 1986—An electrophotographic imaging member is disclosed comprising a charge generation layer, a contiguous charge transport layer and a cellulosic hole trapping material located on the same side of the charge transport layer as the charge generation layer. In one example, the cellulosic hole trapping material may be sandwiched between the charge generation layer and an electrically conductive layer.

U.S. Pat. No. 3,113,022 issued to P. Cassiers et al on Dec. 3, 1963—An electrophotographic imaging member for forming latent conductivity images is disclosed. The conductive layer for the member may include gold and various other materials such as a hydrophilic material comprising a hygroscopic and/or antistatic compound and a hydrophilic binding agent. Suitable hygroscopic and/or antistatic compounds include, for example, glycerine, glycol, polyethylene glycols, hydroxypropyl sucrosemonolaurate, etc. Suitable hydrophilic binding agents include gelatin, polyvinyl alcohol, methylcellulose, carboxymethylcellulose, cellulosesulphate, cellulose hydrogen phthalate, cellulose-acetatesulphate, hydroxyethyl cellulose, etc. for obtaining a good adhesion of a hydrophilic layer and a hydrophobic polymeric sheet. Also, a coating of a polymeric substance may be used on paper sheets to prevent organic polymeric photoconductive substance and radiation sensitive substance from penetrating within the paper sheet. The coating of a polymeric substance must not prevent the carrying off of electrons from exposed image areas during radiation. Coatings include cellulose diacetate, cellulose triacetate, cellulose acetobutyrate, ethyl cellulose, ethyl cellulose stearate or other cellulose derivatives, polymerisates such as polyacrylic acid esters, polymethacrylic acid esters, polycondensates such as polyethylene glycol esters, diethylene glycol polyesters, etc. An organic polymeric photoconductive substance together with a radiation-sensitive substance is dissolved or dispersed in an organic solvent and coated onto the surface of a suitable support.

U.S. Pat. No. 3,245,833 issued to D. Trevoy on Apr. 12, 1966—Electrically conductive coatings useful as antistatic coatings on photographic films are prepared from cuprous iodide and organic polymers in nitrile solvents (e.g. Example 6). Surface resistivities of $7\text{-}9\times10^3$ ohms/square were obtained after spin coating and drying. Thicknesses do not appear to be disclosed. Coating applications do not appear to be electrophotographic and a polymeric insulative binder is always used with the cuprous iodide wherein the semiconductor metal containing compound (CuI) is present in the 15-90 volume percent range.

U.S. Pat. No. 3,428,451 issued to D. Trevoy—Appears to employ some of the conductive coatings described in U.S. Pat. No. 3,245,833 (see above) for use in electrically conductive supports for radiation sensitive recording elements (e.g. an electron microscope where direct electron recording is carried out). Coating applications do not appear to be electrophotographic.

U.S. Pat. No. 3,554,742 issued to—Conductive coatings (e.g. CuI and polymeric binder) described in U.S. Pat. No. 3,245,833 (see above) appear to be employed in electrophotographic applications. A binder is used with the cuprous iodide as the conductive layer. Barrier layers of block copolycarbonates located between the conductive layer (CuI and polymeric binder) and a photoconductive layer (e.g. thiapyrilium) improve adhesion to each and charging levels. However, no cyclic electrical data is provided.

U.S. Pat. No. 3,640,708 issued to W. D. Humphries et al—A mixture of CuI and polymeric binder is employed as a conductive layer for electrophotographic devices. Barrier layers, located as described in reference (3), of a polymeric blend of cellulose nitrate and a complex tetrapolymer of methyl acrylate, acrylonitrile, acrylic acid and vinylidene chloride having a thickness of 0.3 to 0.5 micrometer were found to reduce dark decay and improve adhesion. No cyclic electrical data is provided.

U.S. Pat. No. 3,745,005 issued to W. E. Yoerger et al—A mixture of cuprous iodide in a polymeric binder (polyvinylformal) is employed as a conductive layer. A barrier layer (0.3-7 micrometers) consists of a copolymer of vinylacetate and vinylpyrrolidone or vinylacetate and an $\alpha\beta$-unsaturated monoalkenoic acid gives charging levels in the range of 600 to 700 volts in an RH range of 15-80 percent. Claims 3 and 7 refer to conductive layers of carbon dispersed in a binder although this kind of conductive layer is not discussed elsewhere in this patent. No cyclic electrical data is provided.

U.S. Pat. No. 4,485,161 issued to M. Scozzafava et al—Conductive layers containing cuprous iodide in the polymeric binders are disclosed. Barrier layers were solution or bulk coated from polymerizable and cross-linkable monomers having at least one acrylate or methacrylate group and also having an aromatic nucleus or cycloaliphatic nucleus. The barrier layer coating also contained small amounts of a photosensitizer and an amine activator required to promote UV radiation cure of the neat monomer coating. Dry barrier layer coating thicknesses of 2-8 micrometers were obtained. These devices were capable of supporting electric fields of 1.3 to $1.6\times10^6$ volts/cm under corona charging. The $E_{\frac{1}{2}}$ photosensitivity was about 10 ergs/cm$^2$ (Example 3) of 640 nm incident light. The $E_{\frac{1}{3}}$ photosensitivity (Examples 2, 4, 5 and 6) ranged from 6.7-14.9 ergs/cm$^2$ using the same light source. No test of a barrier layer $V_O$ and $V_R$ behavior with repeated xerographic cycling is given. The above data is for only one cycle. These cross-linked barrier layers do reduce the number of white spots produced in the imaged film. The barrier layer also functions as a solvent barrier to toluene and methylene chloride in addition to its electrical function as a hole injection barrier.

U.S. Pat. No. 4,465,751 issued to K. Kawamura et al—The formation of cuprous iodide conductive layers are disclosed wherein the cuprous iodide is imbibed into the polymeric substrate or a subbing adhesive layer on the polymeric substrate when the cuprous iodide—acetonitrile solution is coated without a binder in the same solution. Thus, a binder for the cuprous iodide is generated underneath the CuI by appropriate solvent swelling and/or heat and the result is a CuI—binder conductive layer. Optionally, a CuI—polymer conductive layer wherein cellulose acetate butyrate is used as the polymeric binder is coated directly. The CuI is imbibed and no distinct CuI layer remains.

U.S. Pat. No. 4,410,614 issued to Lelental et al on Oct. 18, 1983—An electrically activatable recording element is disclosed comprising a polymeric electrically active conductive layer. A list of useful copolymers for the polymeric electrically active conductive layer includes many polymethacrylates that can be found at column 6, lines 36–62. Synthetic polymers are preferred as vehicles and binding agents in the layers of the electrically activatable recording element. The use of polymers such as poly(vinylpyrrolidone), polystyrene and poly(vinylalcohol) is disclosed at column 11, lines 14–58.

U.S. Pat. No. 4,262,053 issued to Burwasser on Apr. 14, 1981—An anti-blocking agent for dielectric film for electrostatographic recording is disclosed. The dielectric imaging element may comprise a dielectric film, a film support and conductive layers. The conductive layers include polymers such as quaternized polymers of vinylpyridine with aliphatic esters, polymers of polyacrylic acid salts with metallic coated polyester films, and the like. The conductive layers may be coated with various dielectric resins including styrenated acrylics.

Koji Abe, Mikio-Koide and Eishum Tcuchida, *Macromolecules* 10 (6), 1259–64 (1977)—A polymeric complex is prepared from 4-vinylpyridine (a basic polymer) and polymethyl acrylic acid (an acidic polymer) to vie a significant amount of the ionized salt structure (FIG. III).

M. M. Coleman and D. J. Skrovanek, Conference Proceeding of 44th ANTEC, 321–2 (1986)—Poly-2-vinylpyridine is shown to interrupt routine hydrogen bonding in an amorphous neutral nylon polymer. The neutral polymer provides an amide hydrogen as a hydrogen bonding site.

U.S. Pat. No. 3,295,967 issued to S. J. Schoenfeld on Jan. 3, 1967—An electrophotographic recording member is disclosed which contains a non-metallic base of high electrical resistivity, a coating on the base for increasing the electrical conductivity, the coating comprising gelatinous hydrated silicic acid and a hygroscopic hydrated inorganic salt, and a photoconductive stratum covering the coating.

U.S. Pat. No. 4,464,450 issued to L. A. Teuscher on Aug. 7, 1984—an electrostatographic imaging member is disclosed having electrically operative layers overlying a siloxane film coated on a metal oxide layer of a metal conductive anode, the siloxane having reactive OH and ammonium groups attached to silicon atoms.

U.K. Patent Application GB No. 2 009 600 A to Tadaju Fukuda et al, published Apr. 23, 1982—A photoconductive member is disclosed comprising a support, a photoconductive layer constituted of an amorphous material comprising silicon atoms as a matrix and a barrier layer between the support and the photoconductive layer, the barrier layer comprising a first sub-layer constituted of an amorphous material comprising silicon atoms as a matrix and containing an impurity which controls the conductivity and a second sub-layer constituted of an electrically insulating material different from the amorphous material constituting the first sub-layer.

Thus, the characteristics of photosensitive members comprising a support having an electrically conductive charge injecting surface, a blocking layer and at least one photoconductive layer, exhibit deficiencies as electrophotographic imaging members.

SUMMARY OF THE INVENTION

It is an object of the invention to provide an electrophotographic imaging member which overcomes the above-noted disadvantages.

It is an another object of this invention to provide an electrostatographic imaging member having extend life.

It is another object of this invention to provide an electrostatographic imaging member that charges to high voltages useful in xerography.

It is another object of this invention to provide an electrostatographic imaging member which is more dark stable.

It is another object of this invention to provide an electrostatographic imaging member which allows photodischarge with low residual voltage during cycling.

It is another object of this invention to provide an electrostatographic imaging member that is simpler to fabricate.

It is another object of this invention to provide an electrostatographic imaging member having a ground plane layer and blocking layer that are resistant to disturbance or dissolving by components of subsequently applied layers.

It is another object of this invention to provide an electrostatographic imaging member having a ground plane layer and blocking layer free of catalytic or cross-linking agents.

These and other objects of the present invention are accomplished by providing an electrophotographic imaging member comprising a supporting substrate, an electrically conductive layer comprising at least a partially cross-linked polymer having a backbone derived from an alkyl acrylamidoglycolate alkyl ether, a charge blocking layer comprising a polymer having a backbone also derived from an alkyl acrylamidoglycolate alkyl ether and at least one photoconductive layer. Preferably, the backbone derived from an alkyl acrylamidoglycolate alkyl ether is a copolymer of methyl acrylamidoglycolate methyl ether and a vinyl hydroxy ester or vinyl hydroxy amide. This imaging member may be prepared by a coating process and employed in an electrostatographic imaging process.

The supporting substrate layer may comprise any suitable rigid or flexible member. The supporting substrate layer may be opaque or substantially transparent and may comprise numerous suitable materials having the required mechanical properties. For example, it may comprise an electrically insulating support layer. Typical underlying flexible support layers include insulating or non-conducting materials comprising various resins or mixtures thereof with or without conductive particles. Typical resins include, for example, polyesters, polycarbonates, polyamides, polyurethanes, and the like. Typical conductive particles include, for example, metals, carbon black and the like. The supporting substrate layer carrying the electrically conductive layer may be rigid or flexible and may have any number of different configurations such as, for example, a sheet, a cylinder, a scroll, an endless flexible belt, and the like. Preferably, the flexible supporting substrate layer comprises an endless flexible belt of commercially available polyethylene terephthalate polyester.

The electrically conductive layer comprises any suitable electrically conductive organic or inorganic particles dispersed in a cross-linked or partially cross-linked polymer having a backbone derived from methyl acrylamidoglycolate methyl ether. The backbone is preferably a copolymer of methyl acrylamidoglycolate methyl ether and a vinyl hydroxy ester or vinyl hydroxy amide. The partially cross-linked polymers are derived at least in part from alkyl acrylamidoglycolate alkyl ethers wherein both the ester and ether alkyl groups are hydrocarbon moieties having 1 to 10 carbon atoms and preferably 1 to 4 carbon atoms and most preferably one carbon atom or a methyl group. The methyl group is preferred at both the ester and ether alkyl position because the cross-linking byproduct, very volatile methanol, is easily evaporated from the coating during routine convection oven drying which is sufficient to effect cross-linking as well as removal of residual solvent. Typical electrically conductive materials include, for example, aluminum, titanium, nickel, chromium, brass, gold, stainless steel, carbon black, graphite, metalloids, cuprous iodide, indium tin oxide alloys, and the like. When hole injecting materials such as carbon black, copper iodide, gold and other noble metals, platinum, polypyrrole, polyaromatic conducting polymers, polythiophenes, conducting metallic oxide such as antimony tin oxide, indium tin oxide, and the like are utilized in a conductive layer, photoreceptors that do not contain a suitable conductive layer or blocking layer can often discharge in the dark thereby rendering the photoreceptor unsuitable for electrophotographic imaging. A ground plane prepared with the film forming binder of alkyl acrylamidoglycolate alkyl ether homopolymer or copolymer of this invention and carbon black is particularly preferred because of the large improvement in adhesion that is achieved. The electrically conductive ground plane layer should be continuous. Generally, the average particle size of the conductive particles dispersed in the film forming binder and the ground plane should be less than the thickness of the ground plane layer and also have an average particle size of less than 30 micrometers. The continuous conductive layer may vary in thickness over substantially wide ranges depending on the desired use of the electrophotoconductive member. For flexible belts, satisfactory flexing of the ground plane layer is achieved with a ground plane layer thickness between about 5 micrometers and about 200 micrometers. Optimum results are achieved with a ground plane layer thickness of between about 10 micrometers and about 100 micrometers. Where the entire substrate is to be conductive, such as a rigid substrate drum, the conductive layer may be of any suitable thickness provided that the layer is continuous. Generally, the proportion of conductive particles to film forming binder in the ground plane layer is between about 10 percent by volume and about 20 percent by volume based on the total volume of the dried layer. The resistivity of the ground plane should be less than about $10^8$ ohms/square and more preferably $10^6$ ohms/square for efficient photoreceptor discharge during repeated cycling. If an underlying flexible support layer is employed, it may be of any conventional material including metal, plastics and the like. The partially cross-linked or cross-linked polymer having a backbone derived from alkyl acrylamidoglycolate alkyl ether in the ground plane of this invention should not be attacked by solvents ultimately selected for use with the subsequently applied layers. If the solvent of subsequently applied layers were to attack a ground plane, it can leach out and/or physically dislodge hole injecting components from the ground plane into the blocking layer. In subsequent coating operations, these already migrated hole injection components in the blocking layer may further migrate into the charge generating layer or charge transporting layer from which dark discharge and low charge acceptance can occur. Since hole injection in the charge generating layer or charge transporting layer is cumulative with xerographic cycling, $V_0$ also decreases with cycling ($V_0$ cycle-down).

A charge blocking layer is interposed between the conductive layer and the imaging layer. The imaging layer comprises at least one photoconductive layer. This blocking layer material traps positive charges. The charge blocking layer of this invention comprises a uniform, continuous, coherent blocking layer comprising a polymer having a backbone derived from alkyl acrylamidoglycolate alkyl ether. If desired, the polymer of this invention derived from alkyl acrylamidoglycolate alkyl ether may be employed in the blocking layer as a linear homopolymer or copolymer or as a cross-linked or partially cross-linked homopolymer or copolymer. Generally, the thickness of the blocking layer depends on the hole injecting capability of the conductive layer. Thus, for conductive layers that are highly hole injecting, such as conductive layers containing copper iodide, a thicker blocking layer is desirable. Satisfactory results may be achieved with a dried coating having a thickness between about 0.02 micrometer and about 8 micrometers. When the thickness of the layer exceeds about 8 micrometers, the electrophotographic imaging member may show poor discharge characteristics and residual voltage build-up after erase during cycling. A thickness of less than about 0.05 micrometer generally tends to result in pin holes as well as high dark decay and low charge acceptance due to non-uniformity of the thickness of different areas of the blocking layer. The preferred thickness range is between about 0.5 micrometer and about 1.5 micrometers. To illustrate how a specific composition selected for the ground plane will influence the thickness of the blocking layer selected, a photoreceptor utilizing a charge injecting ground plane layer containing copper iodide without an overlying blocking layer merely charges to about 3 volts/micrometer. When a sufficiently thick blocking layer of this invention is applied over the ground plane layer containing copper iodide, the photoreceptor will charge to levels at least about 20 volts/micrometer. Charge levels of at least about 30 volts/micrometer are preferred with optimum results being achieved at levels of at least about 40 volts/micrometer. At levels below about 20 volts/micrometer, contrast potential and lighter images cannot be developed with two-component dry xerographic developers. The surface resistivity of the dry blocking layer of the present invention should be greater than about $10^{10}$ ohms/sq as measured at room temperature (25° C.) and one atmosphere pressure under 40 percent relative humidity conditions. This minimum electrical resistivity prevents the blocking layer from becoming too conductive.

The alkyl acrylamidoglycolate alkyl ether utilized in preparing the backbone of the polymer employed in the conductive layer and the blocking layer of photoreceptors of this invention can be represented by the following formula:

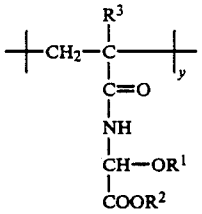

where $R^1$ and $R^2$ are independently selected from lower aliphatic groups containing from 1 to 10 carbon atoms and $R^3$ is hydrogen or a lower aliphatic groups containing from 1 to 10 carbon atoms.

Preferably, $R^1$ and $R^2$ contain from 1 to 4 carbon atoms with optimum results being achieved when $R^1$ and $R^2$ are methyl groups. Typical alkyl acrylamidoglycolate alkyl ethers include, for example, methyl acrylamidoglycolate methyl ether, butyl acrylamidoglycolate methyl ether, methyl acrylamidoglycolate butyl ether, butyl acrylamidoglycolate butyl ether, and the like. Preferably, $R^3$ contains from 1 to 4 carbon atoms with optimum results being achieved when $R^3$ is hydrogen or methyl.

The polymer of this invention derived from alkyl acrylamidoglycolate alkyl ether may be a homopolymer or a copolymer, the copolymer being a copolymer of two or more monomers. The alkyl acrylamidoglycolate alkyl ether monomer utilized in the polymer of this invention may be formed into a linear polymer by polymerization through the unsaturated bond. The monomers utilized to form a copolymer with the alkyl acrylamidoglycolate alkyl ether need not contain hydroxyl groups. Blends of the polymer of this invention with other miscible polymers may also be utilized. The blends should be compatible and be free of any separated phase having an average size of greater than about 10 micrometers. Test layers of the dried solid polymer blend are reasonably clear when any separated phase has an average size of less than about 10 micrometers.

Since the polymer of this invention can be applied as an uncross-linked linear polymer dissolved in a solvent, it may be cross-linked in an oven without the aid of a catalyst and, therefore, can be free of any pot life problem or catalytic residue problem. When the alkyl acrylamidoglycolate alkyl ether of this invention is used as a homopolymer, it may be cross-linked without the presence of any other materials. Cross-linking of this homopolymer may be achieved through the $R^1$ and $R^2$ groups. Satisfactory results may be achieved when the number average molecule weight for the linear homopolymer is at least about 2,000 if the polymer is eventually cross-linked. Preferably, the homopolymer has a number average molecular weight of at least 20,000 with optimum results being achieved with a number average molecular weight of at least about 50,000 prior to cross-linking. If the homopolymer is to remain a linear polymer in the final dried coating, satisfactory results may be achieved with a number average molecular weight of at least about 20,000. Preferably the number average molecular weight is at least about 50,000 and optimum results are achieved with a number average molecular weight of at least 100,000 if the polymer is to remain an uncross-linked linear polymer.

Up to 99 mol percent of any suitable vinyl monomer may be copolymerized with the alkyl acrylamidoglycolate alkyl ether monomer to form a polymer binder of this invention. Typical vinyl monomers include, for example, vinyl chloride, vinyl acetate, styrene, acrylonitrile, N,N-dimethylacrylamide, 2-hydroxyethylacrylate, 2-hydroxyethylmethacrylate, 2-hydroxypropylacrylate, 2-hydroxypropylmethacrylate, hydroxymethylacrylamide, hydroxymethylmethacrylamide, 2-vinylpyridine, 4-vinylpyridine, N-vinylpyrrolidone, methyl methacrylate, and the like.

The preferred alkyl acrylamidoglycolate alkyl ether is methyl acrylamidoglycolate methyl ether which can be represented by the following formula:

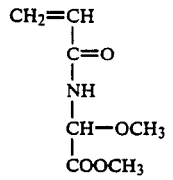

The methyl acrylamidoglycolate methyl ether monomer is commercially available, for example, from American Cyanamid under the trademark MAGME. It is described in American Cyanamid Co. product brochure 4-211-3K as copolymerizable with various other vinyl type monomers. It is also indicated in the brochure that the most likely cross-linking chemical pathways are a function of heating and/or acid catalysis with heating. Methyl acrylamidoglycolate methyl ether monomer is a multi-functional acrylic monomer which, after undergoing a standard vinyl polymerization by itself or with other vinyl monomers to form a linear polymer, provides chemically reactive sites that can be cross-linked by several chemical routes. Cross-linking of the alkyl acrylamidoglycolate alkyl ether homopolymer may be achieved through the $R^1$ and $R^2$ groups. The alkyl ester and alkyl ether reactive sites in the alkyl acrylamidoglycolate alkyl ether repeat units of alkyl acrylamidoglycolate alkyl ether containing polymers can also be reacted with difunctional nucleophiles such as diamines, dialcohols, or bis phenols to give a covalently cross-linked polymer network. Such a cross-linked binder can encapsulate and permanently anchor conductive particles such as carbon black. Subsequently applied coating compositions in various solvents or solvent combinations are incapable of dislodging these particles. Deleterious electrical effects (low charge acceptance, high dark decay and high residual voltage) usually caused by migration of conductive particles are minimized by preventing the upward migration of conductive particles into other layers of the photoreceptor. In all these nucleophilic displacement reactions on alkyl acrylamidoglycolate alkyl ether repeat units in alkyl acrylamidoglycolate alkyl ether containing polymers, an alkanol is evolved. Volatile alcohol by-products such as methanol from methyl acrylamidoglycolate methyl ether repeat units are evolved and leave the coating because the reactions are carried out at about 135° C., well over the boiling point (65° C.) of methanol.

A preferred vinyl monomer copolymerizable with the alkyl acrylamidoglycolate alkyl ether is a vinyl hydroxy ester or vinyl hydroxy amide having the following structure:

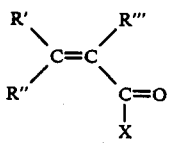

wherein

X is selected from the group consisting of: $-O-R-(OH)_z$, $-NH-R-(OH)_z$, $-N-R-R-(OH)_z$, and

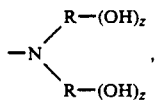

R is a divalent group selected from the group consisting of aliphatic, aromatic, heteroaliphatic, heteroaromatic, fused aromatic ring and heteroaromatic ring groups containing up to 10 carbon atoms;

z is 1 to 10; and

R′, R″ and R‴ are monovalent groups independently selected from the group consisting of hydrogen, lower aliphatic containing 1 to 10 carbon atoms and aromatic, heteroaliphatic, heteroaromatic, fused aromatic ring and heteroaromatic ring groups containing up to 10 carbon atoms.

Typical divalent R aliphatic groups include methylene, ethylidene, propylidene, isopropylidene, butylene, isobutylene, decamethylene, phenylene, biphenylene, piperadinylene, tetrahydrofuranylene, pyranylene, piperazinylene, pyridylene, bipyridylene, pyridazinylene, pyrimidinylene, naphthylidene, quinolinyldene, cyclohexylene, cyclopentylene, cyclobutylene, cycloheptylene, and the like.

Typical monovalent R′, R″ and R‴ groups include hydrogen, methyl, ethyl, propyl, isopropyl, butyl, isobutyl, decyl, phenyl, biphenyl, piperadinyl, tetrahydrofuranyl, pyranyl, piperazinyl, pyridyl, bipyridyl, pyridazinyl, naphthyl, quinolinyl, cyclohexyl, cyclopentyl, cyclobutyl, cycloheptyl, and the like.

Typical aliphatic, aromatic, heteroaliphatic, heteroaromatic, fused aromatic ring and heteroaromatic ring groups containing up to 10 carbon atoms include linear, single ring and multiple ring, fused and unfused groups such as napthalene, thiophene, quinoline, pyridine, furan, pyrrole, isoquinoline, benzene, pyrazine, pyrimidine, bipyridine, pyridazine, and the like.

The copolymer having a backbone derived from alkyl acrylamidoglycolate alkyl ether may be a copolymer of 2 or more different monomers or polymer blocks. Copolymers of alkyl acrylamidoglycolate alkyl ether and vinyl hydroxy ester or vinyl hydroxy amide monomers are particularly preferred because they are non-ionic and neutral and chemically innocuous and do not adversely affect the electrical properties of the photoreceptor. If desired, the copolymer of alkyl acrylamidoglycolate alkyl ether monomer and vinyl hydroxy ester or vinyl hydroxy amide monomer may also be co-reacted with any other suitable reactive monomer.

Examples of preferred embodiments of vinyl hydroxy ester and vinyl hydroxy amide monomers having the above structure include those having the following structure:

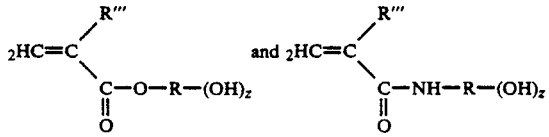

wherein:

R is a lower aliphatic group containing from 1 to 5 carbon atoms,

R‴ is $CH_3$ or hydrogen, and z is 1 to 5.

Optimum results are achieved with monomers having the above structure include those having the following structure:

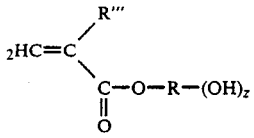

wherein:

R is a lower aliphatic group containing from 2 to 3 carbon atoms,

R‴ is $CH_3$ or hydrogen, and z is 1 or 2.

Typical vinyl hydroxy ester and vinyl hydroxy amide monomers include 4-hydroxybutylmethacrylate, 4-hydroxybutylacrylate, 3-hydroxypropylmethacrylate, 3-hydroxypropylacrylate, 2,3-dihydroxypropylmethacrylate, 2,3,4-trihydroxybutylmethacrylate, 2,3,4-trihydroxybutylacrylate, N-2,3 dihydroxypropylmethacrylamide, N-2,3 dihydroxypropylacrylamide, N-hydroxymethylmethacrylamide, N-hydroxymethylacrylamide, N-2-hydroxyethylmethacrylamide, N-2-hydroxyethylacrylamide, 4-hydroxyphenylmethacrylate, 4-hydroxyphenylacrylate, 3-hydroxyphenylmethacrylate, 3-hydroxyphenylacrylate, N-3 or 4-hydroxyphenylmethacrylamide, N-3 or 4-hydroxyphenylacrylamide, 4(2-hydroxypyridyl)methacrylate, 4(2-hydroxypyridyl)acrylate, 4(3-hydroxypiperidinyl)methacrylate, 4(3-hydroxypiperidinyl)acrylate, N-[4(2-hydroxypyridyl)-]methacrylamide, N-[4(2-hydroxypyridyl)]acrylamide, N-[4(3-hydroxypiperindinyl)]methacrylamide, N-[4(3-hydroxypiperindinyl)]acrylamide, [1(5-hydroxynaphthyl]methacrylate, [1(5-hydroxynaphthyl]acrylate, N-[1(5-hydroxyethylnaphthyl)]methacrylamide, N-[1(5-hydroxyethylnaphthyl)]acrylamide, 1(4-hydroxycyclohexyl)methacrylate, 1(4-hydroxycyclohexyl)acrylate, N-[1(3-hydroxycyclohexyl)]methacrylamide, N-[1(3-hydroxycyclohexyl)]acrylamide, and the like.

These vinyl hydroxy ester or vinyl hydroxy amide monomers can be copolymerized with alkyl acrylamidoglycolate alkyl ether to yield random or block copolymer compositions having a high degree of purity without electrically deleterious catalyst and/or monomer residuals, and at high weight average molecular weights (e.g. ≧100,000).

The copolymer having a backbone derived from alkyl acrylamidoglycolate alkyl ether and a vinyl hydroxy ester or vinyl hydroxy amide may be a copolymer, a terpolymer or the like. Moreover, the copolymer may be a random copolymer or a block copolymer. A preferred copolymer in linear form prior to cross-linking is represented by the following formula:

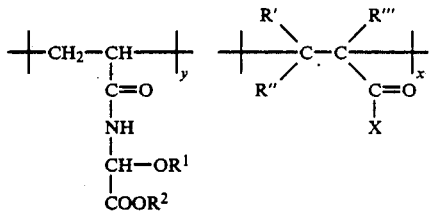

wherein:

$R^1$ and $R^2$ are independently selected from alkyl groups containing from 1 to 4 carbon atoms, y is from 100 mol percent to 1 mol percent, x is from 0 mol percent to 99 mol percent, X is selected from the group consisting of groups represented by the following groups:

—O—R—$(OH)_z$, —NH—R—$(OH)_z$, —N-R—R—$(OH)_z$, and

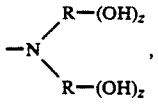

R is selected from the group consisting of aliphatic, aromatic, heteroaliphatic, heteroaromatic, fused aromatic ring and heteroaromatic ring groups containing up to 10 carbon atoms;

z contains from 1 to 10 hydroxyl groups;

R′, R″ and R‴ are independently selected from the group consisting of hydrogen, aliphatic, aromatic, heteroaliphatic, heteroaromatic, fused aromatic ring and heteroaromatic ring groups containing up to 10 carbon atoms.

Generally, satisfactory results may be achieved when x is between about 0 and about 99 mol percent and y is between about 100 and about 1 mol percent. Preferably y is between about 33 and about 90 mol percent and x between about 67 and about 10 mol percent. Optimum results are achieved when y is between about 33 and about 67 mol percent and x is between about 67 and about 33 mol percent. If desired, the alkyl acrylamidoglycolate alkyl ether of this invention may be employed as a homopolymer instead of a copolymer. This homopolymer may be cross-linked without the presence of any other materials. In the random copolymers, x and y repeat units are linearly aligned in random order proceeding down the polymer chain. In the block copolymers, which are substantially blocked, x repeat units substantially follow other x repeat units such that in any 100 repeat unit sequence, at least 70 of the repeat units are of the x type with ≧30 y repeat units randomly dispersed therein. In pure block copolymers, all x repeat units follow y repeat units.

Satisfactory results may be achieved when the number average molecular weight for the linear homopolymer or copolymer is at least about 2,000 if the polymer is eventually cross-linked in the deposited coating. Preferably, the homopolymer or copolymer has a number average molecular weight of at least 20,000 with optimum results being achieved with a number average molecular weight of at least about 50,000 prior to cross-linking. The upper limit for number average molecular weight appears to be limited only by the viscosity necessary for processing.

If the homopolymer or copolymer of this invention is to remain a linear polymer in the final dried blocking layer coating, satisfactory results may be achieved with a number average molecular weight of at least about 20,000. Preferably the number average molecular weight should be at least about 50,000 and optimum results may be achieved with a number average molecular weight of at least 100,000 if the polymer is to remain an uncross-linked linear polymer. The upper limit for number average molecular weight appears to limited only by the viscosity necessary for processing.

Uncross-linked, i.e. linear, embodiments of this copolymer derived from methyl acrylamidoglycolate methyl ether (MAGME) and 2-hydroxyethylmethacrylate (HEMA) or 2-hydroxyethylacrylate (HEA) are particularly insoluble in organic coating solvents used in coatings applied subsequent to the application of the blocking layer providing the MAGME component does not exceed about 40±5 mole percent. Uncross-linked embodiments of this copolymer derived from methyl acrylamidoglycolate methyl ether and 2-hydroxypropylmethacrylate (HPMA) and 2-hydroxypropylacrylate (HPA) exhibit some solubility in tetrahydrofuran and chlorinated alkanes when stirred in those solvents at room temperature for a prolonged time period (overnight). If the solvent evaporation is rapid, such as in coating processes normally employed to manufacture photoreceptors, then tetrahydrofuran or methylene chloride solubility of the copolymer in the blocking layer is an unlikely problem.

Optimum results are achieved with copolymers having a backbone derived from methyl acrylamidoglycolate methyl ether (MAGME) and 2-hydroxyethylmethacrylate (HEMA) represented by the following formula:

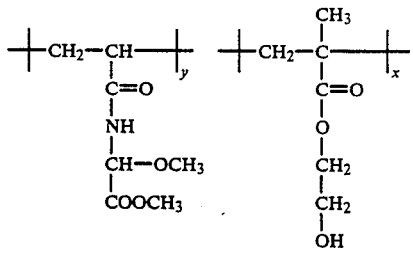

wherein:

y is from 100 mol percent to 1 mol percent and x is from 0 mol percent to 99 mol percent.

Another preferred polymer is one having a backbone derived from methyl acrylamidoglycolate methyl ether (MAGME) and 2-hydroxypropylmethacrylate (HPMA) represented by the following formula:

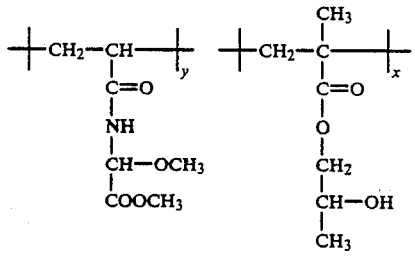

wherein:

y is from 100 mol percent to 1 mol percent and x is from 0 mol percent to 99 mol percent.

Still another preferred polymer is one having a backbone derived from methyl acrylamidoglycolate methyl ether (MAGME) and 2-hydroxyethylacrylate (HEA) which is represented by the following formula:

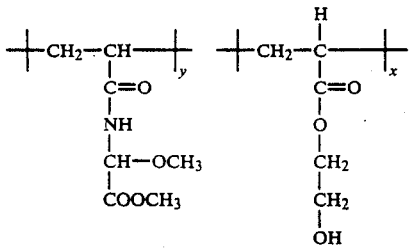

wherein:

y is from 100 mol percent to 1 mol percent and x is from 0 mol percent to 99 mol percent.

Still another preferred polymer is one having a backbone derived from methyl acrylamidoglycolate methyl ether (MAGME) and 2-hydroxypropylacrylate which is represented by the following formula:

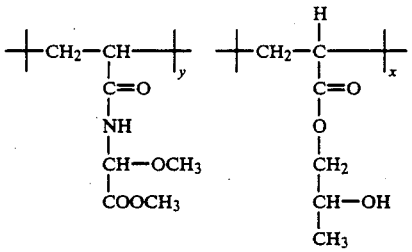

wherein:

y is from 100 mol percent to 1 mol percent and x is from 0 mol percent to 99 mol percent.

Compounds of this invention also include film forming copolymers of the above compounds with one or more copolymerizable vinyl or other suitable monomers. Typical copolymerizable vinyl monomers include acrylonitrile, methacrylonitrile, methylvinylether, and other alkyl and aryl vinyl ethers, styrene and substituted styrenes, ethylene, propylene, isobutylene, vinyl acetate, N,N-dimethylacrylamide, N-vinylpyrrolidone, 2 and 4 vinylpyridine, various methacrylate and acrylate esters and vinyl chloride, and the like. Some monomers that undergo vinyl like polymerizations that are not vinyl monomers may also copolymerize with alkyl acrylamidoglycolate alkyl ether and hydroxy ester or hydroxy amide vinyl monomers. These include, for example, butadiene, isoprene, chloroprene, other conjugated diene monomers and the like.

The polymers of this invention may be blended with other suitable and compatible polymers. Compatible polymers are miscible with the polymers of this invention derived from alkyl acrylamidoglycolate alkyl ethers and other monomers described above. The coating after drying should be substantially clear with any phase separated domain having an average size of less than about 10 micrometers. Two types (Type I and Type II) of compatible blends may be prepared with copolymers of alkyl acrylamidoglycolate alkyl ethers of this invention.

Type I blends are compatible blends in which each polymer contains a common repeat unit as the compatibilizing element. If the first copolymer in the blend contains at least about 25 mole percent of repeat unit X, which is also present in the second copolymer in the same blend to at least about the same extent, then the two copolymers are likely to be sufficiently compatible to meet the less than 10 micrometer domain criteria described above. When the 25 mole percent repeat unit level is increased to greater than or equal to about 33 mole percent common copolymer repeat unit content, the probability of polymer compatibility in the blend (by the above definition) is high. The common copolymer repeat unit may be the alkyl acrylamidoglycolate alkyl ether component or one of the other repeat units listed above. Also, the second polymer to be blended may be a homopolymer (one repeat unit only) wherein the repeat unit is common to one of the repeat units in the first polymer to be blended. Many different repeat unit combinations are possible leading to a broad range of compatible blend compositions having a preferred common repeat unit content of at least 33 mole percent, or expressed in weight percent, 0.10–99.9 percent in each polymer to be blended. In the preferred copolymer compositions, blended or unblended, the non alkyl acrylamidoglycolate alkyl ether repeat unit is comprised of hydroxy ester (or amide) in order to further increase hydrogen bonding density and to enable another thermal cross-linking chemical mechanism between the hydroxyl group and the alkyl acrylamidoglycolate alkyl ether. If cross-linking is not desired in the conductive and/or blocking layer application, then the mole percent of alkyl acrylamidoglycolate alkyl ether repeat unit should be $\geqq 40 \pm 5$ mole percent, when the latter is MAGME, to avoid solvent attack of this layer by subsequently applied coating compositions. If thermal cross-linking of the last coated layer is carried out prior to coating subsequent layers then no maximum exists for the mole percent MAGME repeat unit content in a blended or unblended polymer composition because solubility in subsequently applied coating compositions is precluded. A preferred composition for both conductive and blocking layer applications, either uncross-linked or cross-linked, in this invention comprises about 33 mole percent alkyl acrylamidoglycolate alkyl ether as MAGME and about 67 mole percent 2-hydroxyethyl methacrylate (HEMA) or acrylate (HEA) repeat unit content. Such polymer compositions, blended or unblended, are preferably cross-linked in the conductive layer in order to permanently encapsulate conductive particles therein. However, for blocking layer applications, these same polymer compositions may be used uncross-linked provided the composition is chosen to maintain insolubility in subsequently applied coating compositions. Optionally the blocking layer polymer compositions can be partially thermally cross-linked during solvent evaporation in an air convection oven if additional blocking layer solvent barrier properties are desired.

Typical examples of Type I compatible blend coatings from a casting solvent capable of dissolving equal weights of the two polymers to be blended include the following. The indicated compositional values are mole percent repeat units.

| Polymer 1 | Composition | Polymer 2 | Composition |
|---|---|---|---|
| P(HEMA-MAGME) | 67–33 | P(HEMA) | 100 |
| P(HEMA-MAGME) | 37–63 | P(HEMA) | 100 |
| P(HEA-MAGME) | 50–50 | P(HEA) | 100 |

-continued

| Polymer 1 | Composition | Polymer 2 | Composition |
|---|---|---|---|
| P(HEMA-MAGME) | 37-63 | P(MAGME) | 100 |
| P(DMA-MAGME) | 43-57 | P(HEMA-DMA) | 67-33 |
| P(HEMA-MAGME) | 67-33 | P(HEMA-DMA) | 67-33 |
| P(HEMA-MAGME-MMA) | 33-33-33 | P(HEMA-DMA) | 67-33 |
| P(HEA-MAGME) | 50-50 | P(DMA-MAGME) | 43-57 |
| P(HEMA-MAGME-MMA) | 33-33-33 | P(DMA-MAGME) | 43-57 |
| P(MAGME-VOAc)** | 50-50 | P(DMA-MAGME) | 43-57 |
| P(MAGME-VP) | 50-50 | P(DMA-MAGME) | 43-57 |
| P(MAGME-VP) | 33-67 | P(DMA-MAGME) | 43-57 |
| P(MAGME-MMA) | 50-50 | P(DMA-MAGME) | 43-57 |

The monomer abbreviations (expressed as repeat units) in the above table are as follows:

| | |
|---|---|
| HEMA | 2-hydroxyethyl methacrylate |
| MAGME | methyl acrylamidoglycolate methyl ether |
| HEA | 2-hydroxyethyl acrylate |
| DMA | N,N-dimethylacrylamide |
| MMA | methyl methacrylate |
| VOAc | vinyl acetate |
| VP | N-vinylpyrrolidone |

**This polymer is substantially blocked due to a highly favorable reactivity ratio wherein MAGME is first incorporated into the polymer chain.

Type II compatible blends are blends in which no common repeat unit exists in the blended polymers and compatibility is achieved through extensive hydrogen bonding. This second type of compatible blend can be formed with alkyl acrylamidoglycolate alkyl ether containing polymers and involve strong hydrogen bonding acceptor repeat units in the second polymer. The latter are not strongly basic and include repeat units of ethyloxazoline, vinylpyrrolidone, N,N-dimethylacrylamide and any other tertiary amide containing repeat units. The first polymer to be blended frequently contains alkyl acrylamidoglycolate alkyl ether repeat units and hydroxy ester (or amide) repeat units capable of hydrogen bonding through the hydroxyl group, to the tertiary amide sites of the slight basic hydrogen bonding acceptor repeat units of the second polymer to be blended. This hydrogen bonding maintains sufficient compatibility between the blended polymers with or without subsequent thermal cross-linking of the alkyl acrylamidoglycolate alkyl ether repeat units. A preferred compositional blend comprises, as one component, a copolymer containing repeat units of methyl acrylamidoglycolate methyl ether (MAGME) and 2-hydroxyethyl methacrylate (HEMA) or 2-hydroxyethyl acrylate (HEA) wherein the MAGME repeat unit content is between about 33 and about 63 mole percent and the hydroxyester repeat unit content is between about 37 and about 67 mole percent and, as a second component, poly(ethyloxazoline) P(EOx) homopolymer. Poly(ethyloxazoline) may be represented by the following formula:

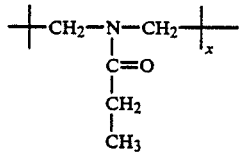

wherein X is a number from 300 to 20,000.

For the preferred blends with poly(ethyloxazoline) described above, the weight percent of each blended polymer is used to define blend composition. For conductive layer and blocking layer photoreceptor applications, the alkyl acrylamidoglycolate alkyl ether containing polymer will dominate the blend composition versus P(EOx) because only the former can be cross-linked (to itself). Consequently the P(EOx), although somewhat constrained by hydrogen bonding to the hydroxyl groups of the cross-linked HEMA-MAGME or HEA-MAGME and by the three dimensional (cross-linked) network itself, can still migrate into subsequently coated layers during solvent coating thereof. Although blends containing equal weights of P(EOx) with HEMA-MAGME or HEA-MAGME copolymers are compatible, these blends are generally not desirable in photoreceptor applications because of the large amounts of P(EOx) that may migrate into other layers causing deficiencies in cyclic electrical properties. Satisfactory conductive and/or blocking layer blend compositions are obtained when about ≦30 weight percent of the blend is P(EOx) and the preferred compositions contain about ≦20 weight percent P(EOx) whereas the optimum compositions contain about ≦10 weight percent P(EOx). The remainder of these blend compositions comprise the alkyl acrylamidoglycolate alkyl ether containing polymer. When the alkyl acrylamidoglycolate alkyl ether containing polymer and the second blendable copolymer [not P(EOx) or P(VOAc-VP)] can be covalently cross-linked to each other during routine oven drying of the wet coating, then polymer migration from such a conductive layer or blocking layer cannot occur during solvent coating of subsequent photoreceptor layers. Consequently, there then exists no limits as to the weight percent of each polymer that can be used in the blend. However, since blocking layers perform better in cyclic electrical testing when hydroxyl-hydroxyl hydrogen bonding density is maximized, preferred blocking layer blend compositions should maximize hydroxyl group content. For uncross-linked photoreceptor applications, the total amount of MAGME and other solubilizing repeat units derived from N,N-dimethylacrylamide (DMA), vinyl acetate (VOAc) and N-vinylpyrrolidone (VP) should be kept at a minimum (≦40±5 mole percent) to prevent macromolecular migration during subsequent coating steps. At least partial cross-linking of photoreceptor conductive layers is preferred for most conductive layers and is also preferred for most blocking layer to enhance solvent barrier properties.

Typical examples of Type II compatible blend coatings from a coating solvent capable of dissolving equal weights of the two copolymers to be blended include the following. The indicated compositional values are mole percent repeat units.

| Polymer 1 | Composition | Polymer 2 | Composition |
|---|---|---|---|
| P(HEA-MAGME) | 50–50 | P(EOx)* | 100 |
| P(HEA-MAGME) | 67–33 | P(EOx)* | 100 |
| P(HEA-MAGME) | 37–63 | P(EOx)* | 100 |
| P(VOH-MAGME)** | 50–50 | P(HEMA-DMA) | 67–33 |
| P(MAGME-VP) | 50–50 | P(HEMA-DMA) | 67–33 |
| P(DMA-MAGME) | 43–57 | P(HEA-HPMA) | 50–50 |
| P(DMA-MAGME) | 43–57 | P(HPMA) | 100 |
| P(DMA-MAGME) | 43–57 | P(VOAc-VP)* | 50–50 |
| P(DMA-MAGME) | 43–57 | P(VOH-VP) | 50–50 |
| P(DMA-MAGME) | 43–57 | P(HEMA-VP) | 80–20 |
| P(DMA-MAGME) | 43–57 | P(HEMA-VOAc) | 50–50 |
| P(DMA-MAGME) | 43–57 | P(HEMA-HEA) | 50–50 |
| P(DMA-MAGME) | 43–57 | P(HEMA-MMA) | 50–50 |
| P(DMA-MAGME) | 43–57 | P(HEMA-Styrene) | 54–46 |
| P(DMA-MAGME) | 43–57 | P(HEMA-Acrylonitrile) | 50–50 |
| P(MAGME-VP) | 33–67 or 50–50 | P(HEMA) | 100 |

The monomer abbreviations (expressed as repeat units) in the above table are as follows:

| | |
|---|---|
| HEMA | 2-hydroxyethyl methacrylate |
| MAGME | methyl acrylamidoglycolate methyl ether |
| HEA | 2-hydroxyethyl acrylate |
| DMA | N,N-dimethylacrylamide |
| MMA | methyl methacrylate |
| VOAc | vinyl acetate |
| VP | N-vinylpyrrolidone |
| EOx | ethyl oxazoline |
| HPMA | 2-hydroxypropyl methacrylate |
| VOH | vinyl alcohol |

*Indicates that these polymers cannot be cross-linked with themselves or with any of the repeat units in Polymer 1. For all other blends, Polymers 1 and 2 are capable of cross-linking with each other during oven drying of the coating at the prescribed cross-linking conditions in an air convection oven.

**This polymer is substantially blocked due to a highly favorable reactivity ratio wherein MAGME is first incorporated into the polymer chain.

The backbone derived from alkyl acrylamidoglycolate alkyl ether is always cross-linked or partially cross-linked in the ground plane layer and either uncross-linked, partially cross-linked or cross-linked in the blocking layer. A cross-linked or partially cross-linked polymer is utilized in the ground plane layer because conductive particles such as carbon black are encapsulated thereby preventing migration of the conductive particles into layers above during coating thereof. This migration causes lower charge acceptance and possibly $V_R$ cycle-up so it is desirable to avoid such conductive particle migration. Cross-linking may be effected by merely applying heat with or without the presence of an acid during the drying step after the homopolymer or copolymer is applied as a coating from a solvent solution. The degree of cross-linking may be adjusted by the heating temperature and level of acid doping. Cross-linking of the methyl acrylamidoglycolate methyl ether homopolymer may be achieved through the $R^1$ and $R^2$ groups. When hydroxy repeat units derived from vinyl hydroxy ester or vinyl hydroxy amide monomers are reacted with the alkyl acrylamidoglycolate alkyl ether, covalent cross-linking may be achieved by displacement of the ether alkoxy and the lower alkyl ester group. Limited or partial cross-linking of alkyl acrylamidoglycolate alkyl ether repeat units in the conductive layer is desirable for above reason and also because the remaining uncross-linked alkyl acrylamidoglycolate alkyl ether repeat units on the conductive layer surface remain available to react with hydroxyl groups from vinyl hydroxy ester or vinyl hydroxy amide units and/or alkyl acrylamidoglycolate alkyl ether units in the blocking layer. This is desirable because it enables chemical reactions to occur to form covalent bonds across the conductive layer-blocking layer interface thereby improving adhesion between these two layers. Cross-linking of the polymer in the conductive layer does not impact conductivity. Thus, for example, thick (e.g. 8–10 micrometer) carbon black loaded (e.g. 15 weight percent) conductive layers are bulk conductive giving four point test probe resistivities of $10^3$–$10^4$ ohms/square at all ambient humidities. Since cross-linking of the copolymer in the blocking layer creates a more solvent resistant barrier layer to subsequently applied coating compositions, cross-linked polymers in the blocking layer are preferred.

Generally, in the absence of an acid dopant, the solvent will be driven off and the polymer coating remaining will be uncross-linked if the drying temperature is maintained at less than about 90° C. At drying temperatures greater than about 120° C., the polymer coating remaining will be cross-linked. At temperatures of between about 90° C. and about 120° C. copolymers that contain both an alkyl acrylamidoglycolate alkyl ether repeat unit and a hydroxy containing repeat unit are likely to be partially cross-linked. Because these polymers can be easily cross-linked during routine drying of photoreceptor coatings, this method of cross-linking is extremely convenient (no extra drying step or extra cross-linking materials or catalysts) in fabricating photoreceptors by any fabrication method involving an oven drying step.

Cross-linking between substantially identical copolymer chains can occur by two chemical routes. Methyl acrylamidoglycolate methyl ether units in one copolymer chain can self condense with methyl acrylamidoglycolate methyl ether units in a second polymer chain to give a complex methylene bis amide cross-link illustrated below:

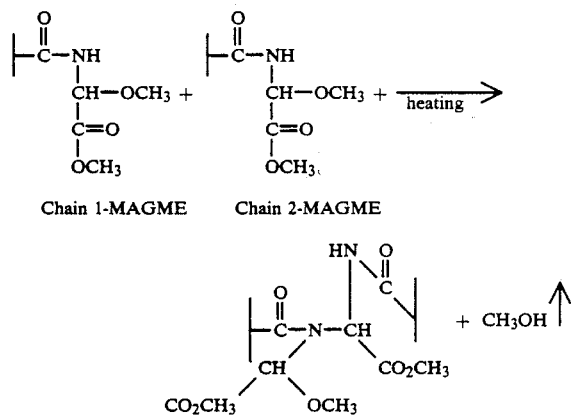

This cross-linking pathway is believed to be a minor pathway at temperatures less than about 120° C. because this chemical reaction takes place slowly at 135° C. in the absence of an acid catalysis. However, when acid catalysis is employed, this pathway becomes more important at temperatures of about ≦120° C. Since migration of the small molecule acid species (p-toluenesulfonic acid) into other layers (during coating thereof) can cause deleterious electrical effects, cross-linking of these conductive layers without acid catalysis is preferred with cross-linking being accomplished by merely applying heat while simultaneously removing the coating solvent in, for example, an air convection oven. Thus, the chemical reaction depicted above remains a minor cross-linking pathway, leaving the bulk of the methyl acrylamidoglycolate methyl ether repeat units available to participate in the second cross-linking pathway which is less dependent on acid catalysis at about 120° C.-135° C.

The second cross-linking pathway is shown below:

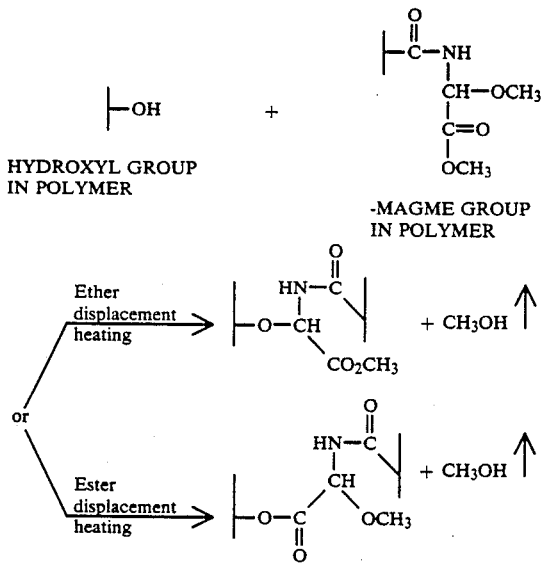

In this second cross-linking pathway, hydroxyl groups from one copolymer displace both the ether and ester methoxyl groups of another copolymer to give the corresponding ether and ester cross-links. This reaction proceeds rapidly at 135° C. even without acid catalysis when the polymers contain OH groups and MAGME groups.

For conductive layers, the polymer should be sufficiently cross-linked to ensure substantial insolubility in solvents employed to apply the blocking layer. Substantial insolubility can be determined by tests showing that the polymer fails to redissolve at about 1 percent by weight in the originally used coating solvent and in subsequently used coating solvents.

The conductive layer coating mixture and blocking layer coating mixture are applied to the surface of the supporting substrate and the surface of the conductive layer, respectively. The conductive layer coating mixture and blocking layer coating mixture of this invention may be applied by any suitable conventional technique. Typical application techniques include spraying, dip coating, roll coating, wire wound rod coating, drawbar coating, and the like. Coating compositions are usually applied with the polymer dissolved in a solvent. Typical solvents include methanol, 1-methoxy-2-hydroxypropane, tertiary butyl alcohol, water and mixtures of these solvents with other alcohol solvents and tetrahydrofuran and the like. Choice of solvents for the conductive layer depends upon the nature of the supporting substrate upon which the conductive layer is applied and also on the properties of the polymers constituting the conductive layer. Because the dried conductive layer is cross-linked or partially cross-linked, it is substantially insoluble in any solvent selected for application of subsequently applied layers. Appropriate solvents can, in general, be selected based on the known properties of the individual polymers, as is well known in the art. Mixtures of solvents may also be used, if desired. The proportion of solvent to be utilized varies with the type of coating technique to be employed, e.g., dip coating, spray coating, wire wound bar coating, drawbar coating, roll coating, and the like so that the viscosity and volatility of the coating mixture is adjusted to the type of coating technique utilized. Generally, the amount of solvent ranges from between about 99.8 percent by weight to about 90 percent by weight, based on the total weight of the coating composition. Typical combinations of specific solvents and polymers include, for example, alkyl acrylamidoglycolate alkyl ether derived polymer such as HEMA-MAGME copolymers or HEA-MAGME copolymers and 1-methoxy-2-hydroxypropane (Dowanol PM, available from Dow Chemical Co.) or tertiary butyl alcohol. Basic alcohols such as dimethylaminoethanol and acidic alcohols such as 2,2,2-trifluoroethanol also dissolve alkyl acrylamidoglycolate alkyl ether derived polymers such as HEMA-MAGME copolymers or HEA-MAGME copolymers significantly at room temperature but solvent neutrality is usually desirable to avoid interference with the ground plane or other layers affecting photoreceptor electrical performance due to residual trace amounts of solvent. High boiling dipolar aprotic solvents such as dimethylformamide, dimethylacetamide and N-methylpyrrolidone (DMF, DMAC and NMP respectively) also dissolve alkyl acrylamidoglycolate alkyl ether derived polymers such as HEMA-MAGME copolymers or HEA-MAGME copolymers extensively but are less desirable because total solvent removal from the coatings is more difficult to achieve due to the high boiling points of these solvents. Thus, there are a limited number of solvents suitable for coating high molecular weight alkyl acrylamidoglycolate alkyl ether derived polymers such as HEMA-MAGME copolymers or HEA-MAGME copolymers. The limited solubility of high molecular weight alkyl acrylamidoglycolate alkyl ether derived linear polymers in common organic solvents for blocking layers is desirable because the deposition of subsequent device layers, such as the generator layer from solutions using common solvents such as toluene and tetrahydrofuran and the transport layer using common solvents such as methylene chloride and other chlorinated alkanes does not cause extensive solvent induced migration of these alkyl acrylamidoglycolate alkyl ether derived linear polymers from the blocking layer into the layers overlying the blocking layer. Limited solubility occurs, for example, when the polymers are uncross-linked if $\leqq 40 \pm 5$ weight percent MAGME is in the alkyl acrylamidoglycolate alkyl ether copolymer, or if the alkyl acrylamidoglycolate containing polymer or polymer(s) of a blend are cross-linked.

If desired, minor amounts of optional additives may be added to the conductive layer coating composition or blocking layer coating composition to promote improved wetting of the underlying surface. Any suitable additive may be employed. Typical additives include wetting agents such as Surfynol (available from Air Products and Chemicals, Inc.), and the like. Other additives include plasticizers such as glycerol, diethylene glycol, p-toluene ethyl sulfonamide, and the like. Similarly, other additives such as dyes and the like may also be added. Generally, the amount of optional additive added should be less than about 2 percent by weight, based on the total weight of the dried conductive layer or blocking layer coating.

If the conductive or blocking layer polymer is soluble in any of the organic solvents used in coating subsequent layers, the thickness uniformity and integrity thereof could be adversely affected because the organic solvents may wash the conductive and/or blocking layer material into the charge generating layer and/or charge transport layer. Thinner blocking layer or areas devoid of blocking layer material can result in very poor or even negligible device charge acceptance and high dark charge decay rate.

The molecular weight of the alkyl acrylamidoglycolate alkyl ether derived linear polymers of this invention, as indicated by a dilute solution viscosity measurement, such as inherent viscosity, intrinsic viscosity, or reduced viscosity, is believed to be important in uncross-linked blocking layer applications because higher molecular weight polymers (all other things being equal) swell much more slowly than lower molecular weight polymers. Moreover, during fabrication of the charge generating layer and/or charge transport layer, solvent contact with the surface of the blocking layer will cause less physical disruption of the top of the blocking layer when a high molecular weight polymer is utilized. This further preserves the thickness uniformity of the hole blocking layer and its ability to function effectively.

After the conductive layer or blocking layer coating is applied, the deposited coating is heated to drive out the solvent and form a solid continuous film. Generally, a drying temperature between about 120° C. and about 135° C. is preferred for drying the conductive layer and to ensure sufficient cross-linking of the copolymer in the absence of an acid catalyst. Lower temperatures may be employed if an acid catalyst is used. For conductive layers, the copolymer should be sufficiently cross-linked to ensure substantial insolubility in solvents employed to apply the blocking layer. Substantial insolubility can be determined by tests showing that the polymer fails to redissolve at about 1 percent by weight in the originally used coating solvent and in subsequently used coating solvents. For drying of a blocking layer coating to be cross-linked, a temperature of between about 120° C. and about 135° C. is preferred to minimize any residual solvent, and to minimize any distortion to organic film substrates such as biaxially oriented polyethylene terephthalate. Although cross-linking of the polymer in the blocking layer is preferred, the polymer need not be cross-linked during drying. For forming dried blocking layers containing uncross-linked polymers, the drying temperature and time can be sufficient to remove the coating solvent (for example about 1 hour at about 90° C.), but insufficient to cross-link the polymer. However, the blocking layer polymer should be substantially insoluble in solvents employed to apply subsequent layers. The temperature selected also depends to some extent on the temperature sensitivity of the substrate. The drying temperature may be maintained by any suitable technique such as ovens, forced air ovens, radiant heat lamps, and the like. The drying time depends upon the temperatures used. Thus, less time is required when higher temperatures are employed. Generally, increasing the drying time increases the amount of solvent removed. One may readily determine whether sufficient drying has occurred by chromatographic or gravimetric analysis. A typical treatment for a cross-linked blocking layer involves application of the coating with a half mil Bird coating bar followed by heating of the deposited coating at 130° C. for about 30 to 60 minutes.

Some of the blocking layer materials of this invention can form a layer which also functions as an adhesive layer. However, if desired, an optional adhesive layer may be utilized. Any suitable adhesive material may be applied to the blocking layer. Typical adhesive materials include polyesters (e.g. 49000, available from E. I. duPont de Nemours & Co. and PE100 and PE200, available from Goodyear Tire & Rubber Co.) polyvinylbutyral, polyvinyl formal, polyvinylpyrolidone, polyamide, polyurethane, polyvinyl acetate, polyvinyl chloride, polyimide, polycarbonate, copolymers thereof, blends thereof and the like. Generally, satisfactory results may be achieved with adhesive layers having a thickness of between about 0.01 micrometer to about 0.20 micrometer. A preferred thickness is from about 0.02 micrometer to about 0.12 micrometer. Optimum results are achieved with a thickness of about 0.03 micrometer (300 angstroms) to about 0.12 micrometer from materials such as polyvinyl pyridine. Adhesive layers are especially useful for enhancing adhesion to charge generation layers containing materials, such as polyvinyl carbazole, which adhere poorly to vinyl hydroxy ester or vinyl hydroxy amide blocking layer polymers. Typical adhesive layer materials are those producing strong hydrogen bonds with vinyl hydroxy ester or vinyl hydroxy amide polymers such as poly(4-vinylpyridine), poly(2-vinylpyridine), and the like. Adhesive layers containing poly(4-vinylpyridine) form a hydrogen bonded polymeric complex with vinyl hydroxy ester or vinyl hydroxy amide blocking layer polymers which are believed to be unique adhesive compositions having solubility properties which allow the adhesive layer to also function as a solvent barrier layer.

Generally, as described above and hereinafter, the electrophotoconductive imaging member of this invention comprises a supporting substrate, an electrically conductive layer containing a cross-linked or partially cross-linked alkyl acrylamidoglycolate alkyl ether derived polymer, a blocking layer containing an alkyl acrylamidoglycolate alkyl ether derived polymer and at least one photoconductive imaging layer. The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound are dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium arsenic, selenium tellurium, selenium arsenic antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor embodiment of this invention. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinacridones, substituted 2,4-diaminotriazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. Nos. 4,265,990, 4,233,384, 4,471,041, 4,489,143, 4,507,480, 4,306,008, 4,299,897, 4,232,102, 4,233,383, 4,415,639, and 4,439,507. The disclosure of these patents are incorporated herein by reference in their entirety.

Any suitable inactive resin binder material may be employed in the charge generator layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. Nos. 3,121,006 and 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, the photoconductive material need only to comprise about 1 percent or less by volume of the binder layer with no limitation on the maximum amount of photoconductor in the binder layer. Generally for charge generator layers containing an electrically active matrix or binder such as poly-N-vinyl carbazole, from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the charge generation layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. does not discharge at a rate sufficient to prevent the formation and retention of an electrostatic latent image thereon.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor embodiment of this invention comprises from about 25 to about 75 percent by weight of at least one charge transporting aromatic amine compound, and about 75 to about 25 percent by weight of a polymeric film forming resin in which the aromatic amine is soluble.

Examples of charge transporting aromatic amines represented by the structural formulae above for charge transport layers capable of supporting the injection of photogenerated holes of a charge generating layer and transporting the holes through the charge transport layer include triphenylmethane,bis(4-diethylamine-2-methylphenyl)phenylmethane; 4'-4''-bis(diethylamino)-2',2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyester, polyarylate, polystyrene, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G., a polycarbonate resin having a molecular weight of from about 20,000 to about 50,000 available as Merlon from Mobay Chemical Company and poly(4,4'-diphenyl-1,1-cyclohexane carbonate). Methylene chloride solvent is a particularly desirable component of the charge transport layer coating mixture for adequate dissolving of all the components and for its low boiling point. However, the type of solvent selected depends on the specific resin binder utilized.

In all of the above charge transport layers, the activating compound which renders the electrically inactive polymeric material electrically active should be present in amounts of from about 15 to about 75 percent by weight.

If desired, the charge transport layer may comprise any suitable electrically active charge transport polymer instead of a charge transport monomer dissolved or dispersed in an electrically inactive binder. Electrically active charge transport polymer employed as charge transport layers are described, for example in U.S. Pat. Nos. 4,806,443, 4,806,444, and 4,818,650, the entire disclosures thereof being incorporated herein by reference.

Any suitable and conventional technique may be utilized to mix and thereafter apply the charge transport layer coating mixture to the charge generating layer. Typical application techniques include spraying, dip coating, roll coating, wire wound rod coating, draw bar coating, web coating and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

Thus, this invention extends the life of electrostatographic imaging members. A cross-linking mechanism may be utilized that is only catalyzed by heat normally applied during conventional photoreceptor drying conditions (time and temperature) with the evolution of a non-toxic volatile by-product leaving no residue anywhere in the device. Another advantage of crosslinked polymer coatings is that the cross-linking capability can come, not from an externally added low molecular weight cross-linking agent which may not be totally consumed and may in part migrate to other layers in the photoreceptor, but be derived from pendant groups already in a repeat unit of a high molecular weight polymer. This method of incorporating the cross-linking sites precludes interlayer contamination by a relatively low molecular weight cross-linking agent which could migrate to other layers during solvent coating of those subsequent layers. In addition, any unused pendant cross-linking sites in the polymer as well as newly formed cross-links are nondeleterious (or innocuous) to acceptable photoreceptor electrical performance. Cross-linking the ground plane polymer containing a particulate conductive substance, such as a conductive carbon black, ensures network enclosure of the conductive particles, thus imparting greater solvent resistance (chemical stability) to subsequently used solvent coating compositions. The possibility of particle escape and upward migration into the other layers of the photoreceptor where deleterious hole injection would occur is eliminated in cross-linked solvent resistant ground planes. Cross-linking the blocking layer polymer adds even more chemical resistance to subsequently applied coating compositions. Moreover, the polymer materials employed in the conductive and blocking layers of this invention posses a longer shelf life are non-toxic, are homogeneous, are free of phase separated materials and can be easily cross-linked. The blocking layers of this invention form a solvent barrier layer to most of the commonly used coating solvents used to coat the layers overlying the blocking layer, e.g. is substantially insoluble in solvents such as toluene, tetrahydrofuran and methylene chloride. The expression "substantially insoluble" as employed herein is defined as polymer insolubility of less than about 1 percent by weight at room temperature in coating solvents used during or subsequent to application of the blocking layer of this invention. The blocking layer of this invention is electrically hole blocking during and after corotron charging prior to photodischarge. Photoreceptors containing the blocking layer of this invention are also more dark stable. This prevents ground plane hole injection and enables high $V_O$ charging initially and with repetitive cycling. The blocking layers of this invention electrically accept photodischarged electrons from the generator layer and transport most or all of the accepted electrons to the ground plane to complete the discharge process. Thus, the electrostatographic imaging member of this invention allows photodischarge with low residual voltage during cycling under most ambient relative humidities. This enables total discharge within the xerographic time scale, and thus low $V_R$ initially and with repetitive cycling.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A sample of 2-hydroxyethylmethacrylate monomer (HEMA) (99.5%-BM-920, available from Rohm Tech. Inc.) containing 200 ppm methylhydroquinone inhibitor was processed immediately prior to polymerization to remove the inhibitor by passing the bulk monomer through (4×) a Dehibit 100 (Polysciences, Inc.) macroreticular ion exchange resin gravity packed (eight inch long by one inch diameter) glass column. 81.0 g (0.62 mole) of the deinhibited HEMA monomer and 69.3 g (0.40 mole) of methyl acrylamidoglycolate methyl ether monomer (MAGME-100 monomer, available from American Cyanamid) were charged into a 5 liter three neck round bottom flask equipped with a Teflon coated magnetic stirring football, an Argon inlet tube, and an Argon outlet on top of a water condenser which exited to a mineral oil bubbler used to monitor the presence of a positive inert gas flow during the polymerization process. 1.5 liters of methanol was charged to the reaction vessel and Argon was vigorously bubbled through the solution for about 0.5 hour prior to adding 0.5 gram (0.3 mole % based on total moles of monomer) AIBN initiator. The solution was refluxed using a heating mantle as a heat source for 63 hours while bubbling Argon through the solution and magnetically stirring. After cooling the polymer solution to room temperature, about 25 volume percent was coagulated into 3 liters of toluene. This polymer coagulation process was repeated three additional times on the remaining 75 volume percent polymer solution split into 3 equal portions. The toluene coagulation solvent was decanted from the settled polymer and the remaining small liquid volume was vacuum filtered on a medium frit funnel. The combined coagulated white polymeric solid was pressed dry on the Teflon surface of a Teflon coated aluminum tray and, after air drying for 3 days in a fume hood, was dried for 1 day in a vacuum oven (−0.5 mm Hg) at 50° C. and was thereafter easily pulverized with a mortar and pestle. The pulverized solid was further dried in vacuo as previously described except at 55°-60° C. for about two days. The thoroughly dried white polymeric solid amounted to 134.1 grams which is 89.2 percent of theory and the polymer was totally soluble in methanol (the preparation solvent) indicating the absence of cross-linking at the above synthesis and drying conditions. Analysis of the copolymer by both $C^{13}$-NMR and Nitrogen elemental analysis indicated that the copolymer consisted of about 2 repeat units of HEMA for every repeat unit of MAGME. The copolymer was further characterized by Thermogravimetric analysis using a DuPont 951 thermogravimetric analyzer (furnace) and a DuPont 990 thermal analyzer (controller) at a flow rate of 400 ml/min. At a heating rate of 20° C./min, weight loss onset occurred at 127° C. implying the absence of significant amounts of trapped solvent (methanol or toluene). Since toluene forms a binary azotrope with both methanol and water, the latter was completely removed during drying of the toluene coagulated polymer. Isothermal TGA at 122° C. indicated a rapid initial weight loss of 9.4 percent in the first 1.8 minutes with insignificant additional weight loss in the next hour. Based on the chemistry of cross-linking between HEMA hydroxyl groups and MAGME units, and between MAGME units alone as described in the technical brochure from American Cyanamid entitled "MAGME-Multi-Functional Acrylic Monomer", the weight loss observed with the above copolymer is assignable to methanol—the volatile and only by-product of cross-linking this copolymer. If all the HEMA repeat unit hydroxyl groups were to react with the two reactive sites in each MAGME repeat unit, then the anticipated theoretical weight loss would be 14.8 percent. On this basis, the observed weight loss of 9.4 percent implies that the cross-linking, as defined in the above mechanistic mode was 63.5 percent complete in the first 1.8 minutes of heating at 122° C. The speed of reaction was more than sufficient to enable cross-linking to occur during the normal solvent removal drying periods employed for photoreceptor fabrication. The absence of further methanol evolution, which signifies further cross-linking, in the subsequent hour of TGA heating at 122° C. implies the covalently crosslinked network had become so rigid that the remaining potentially reactive cross-linking sites could not locate each other to continue cross-linking.

EXAMPLE II

The drawbar coated devices of this Example were fabricated on 3 or 4 mil thick polyvinyl fluoride film (Tedlar BG-20SE, available from E. I. duPont de Nemours & Co.) which had been corona treated. The HEMA-MAGME copolymer prepared as in Example I was used as the binder for the conductive carbon black in all the conductive layers of this Example and in many of the blocking layers. A Model P290 Gardner Labs, Inc. coating apparatus and drawbar applicators were used to coat all the layers in these devices. The coating compositions and coating application processes for these devices are as follows.

The ground plane compositions were formulated in a 2 ounce amber colored bottle as follows for Composition A.

(1) 5.32 grams HEMA-MAGME copolymer (prepared as described above, but not cross-linked)
(2) 30.0 grams methanol solvent
(3) 0.94 gram BP-2000 (Cabot Corp.) conductive carbon black
(4) 0.01 gram of p-toluenesulfonic acid monohydrate (p-TSA) from a stock solution of 5 mg/ml methanol solution (2 ml)
(5) 50 g. of one-eight inch stainless steel shot The very low level (0.19 wt. percent based on the copolymer) of catalyst in this composition is optional. Similar compositions without any catalyst yield similar electrical results when the completed photoreceptor is electrically evaluated in the same way. The copolymer and solvent were mixed and allowed to dissolve by agitating with a wrist shaker for about 1 hour. To this solution was added the carbon black (15 wt. percent based on copolymer) and the steel shot and the mixture was dispersed for 90 minutes using a paint shaker. When p-TSA was employed as catalyst, the small volume of p-TSA stock solution was added to this dispersion just prior to coating. The dispersion was drawbar coated (3 mil bar gap Bird applicator) on the polyvinyl fluoride film substrate and the coating was dried for 1 hour or overnight in a dry atmosphere (<30% RH) and then for 1 hour at 135° C. to completely remove solvent and to cross-link the copolymer. No significant change in electrical properties was observed because of the difference in ambient drying time. The dried coating thickness was 8–10 micrometers as measured with a Twin City International, Inc. autotest DS permascope. Three levels of p-TSA were used for these ground plane compositions and Dowanol PM (same weight) could be used in place of methanol as the solvent. These three levels are shown in the Table below:

| Composition | Copolymer Weight (g) | Solvent Weight (g) | p-TSA Catalyst Weight (g) | wt. % p-TSA versus Copolymer |
|---|---|---|---|---|
| A | 5.32 | 30.0 | 0.01 | 0.19 low acid |
| B | 5.32 | 30.0 | 0.10 | 1.84 high acid |
| C | 5.32 | 30.0 | 0.00 | 0.0 no acid |

After application and drying of the conductive layer, a blocking layer was applied to some of the coated substrates. The blocking layer, when used, consisted of high molecular weight poly 2-(hydroxyethylmethacrylate) (HEMA) available from Scientific Polymer products or the HEMA-MAGME copolymers described in this work. Dowanol PM was used as solvent and the solutions were made up at 6 wt. percent solids. Coating these solutions with a 0.5 mil Bird applicator gap on top of the dried conductive layer yielded an 0.8–1.0 micrometer thick blocking layer after drying at 1 hour at ambient conditions and 1 hour at 135° C. The thickness/concentration relationship of the coatings using a 0.5 mil bar gap was determined with a Dektak® surface profile measuring system. In order to determine thickness, a coating solution concentration versus dry coating thickness relationship for the polymers layers was established for a 0.5 mil drawbar gap used to coat these layers. The polymer was coated onto smooth 2"×2" glass substrates from a suitable solvent at four concentrations, 1.2, 3.6, 6.0 and 8.4 weight percent. After drying as described above (standard conditions), the dry thickness of the coatings was measured with a Dektak® surface profile measuring system available from Sloan Technology Corp. (Model #900050). The Dektak® system uses a hemispherical diamond stylus of 0.0001" radius to make the measurement. This instrument measures thickness by drawing the stylus over the coated surface and then off the coated edge onto the high tolerance uncoated smooth glass (Corning #7059) surface. The vertical step from the coated surface to the smooth glass surface is simultaneously amplified and recorded on thickness calibrated graph paper enabling rapid measurement of the step and thus the thickness. Dektak® steps were measured at four different surface locations in each of three coatings made from a given concentration of polymer. For a given coating, a 2–6 percent thickness variation was found, and the thickness variation among the three coatings made from the same concentration of polymer was always less than 10 percent. These measurements enabled coating thickness ranges as indicated in this Example. Using the polymer dry coating thickness versus concentration curve for other polymers and copolymers, coated from sufficiently viscous solutions which totally fill the 0.5 mil drawbar gap, is a valid extension of the correlation because these polymers have similar densities. Thus, the thickness will reside within the cited ranges.

A typical formulation for the blocking layers was prepared in a 2 ounce amber colored bottle as follows for composition A':

(1) 0.60 gram HEMA or HEMA-MAGME
(2) 9.40 gram Dowanol PM solvent
(3) 0.001 gram p-TSA (0.2 ml of previously described stock solution) The mixture was agitated for 2–3 hours at room temperature on a wrist shaker to obtain a polymeric solution.

| Composition | Copolymer Weight (g) | Solvent Weight (g) | p-TSA Catalyst Weight (g) | wt. % p-TSA versus Copolymer |
|---|---|---|---|---|
| A' | 0.60 | 9.40 | 0.001 | 0.17 low acid |
| B' | 0.60 | 9.40 | 0.010 | 1.64 high acid |
| C' | 0.60 | 9.40 | 0.000 | 0.0 no acid |

The p-TSA catalyst was not used with blocking layers that did not contain MAGME such as P(HEMA) blocking layers.

A thin (<0.1 micrometer) poly(4-vinylpyridine) [P(4VPy)]) adhesive layer was drawbar coated between the blocking layer and photogenerator layer. A typical poly(4 vinylpyridine) adhesive layer formulation contained 0.6 weight percent solution of 0.12 g Reillene® 4200 (Reilly Tar & Chemical Co.) in 17.89 g isobutanol and 1.99 g isopropanol. After applying this solution as a coating with a 0.5 mil drawbar gap, the coating was dried ambiently for one hour and then for one hour at 100° C. in an air convection oven (standard conditions). When the poly(4 vinylpyridine) adhesive layer was drawbar fabricated in devices of subsequent examples, the above formulation, coating procedure and drying conditions were used unless otherwise indicated.

A charge generator layer mixture was prepared by forming a dispersion of about 8.57 g trigonal selenium particles doped with about 1–2 percent by weight sodium hydroxide, 6.72 g polyvinylcarbazole, 4.93 g N,N-bis-(3"-methylphenyl)-[1,1'-biphenyl]-4,4'-diamine, 100.55 g tetrahydrofuran and 100.55 g toluene. This dispersion was then diluted with an equal weight of toluene. The diluted dispersion was next agitated on a paint shaker for about 5 minutes immediately prior to coating the conductive layer with a 1 mil drawbar gap. The charge generator coating was next dried for one hour at room temperature and for one hour at 100° C. in an air convection oven. The dry thickness of the photogenerator layer thus obtained was about 1.0±0.3 micrometer in this and subsequent Examples.

A charge transport layer coating mixture was prepared by mixing about 2.8 g N,N'-bis(3"methylphenyl)-[1,1'biphenyl]-4,4"diamine, 4.2 g polycarbonate resin (Makrolon® 5705, available from Farbenfabricken Bayer A. G.) and 40 g methylene chloride. This mixture was coated with a 5 mil drawbar gap onto the photogenerator layer. The transport layer coating was dried at room temperature for one hour, and then through an incremental heating cycle from 50° to 100° C. in 0.50 to 0.75 hour and finally at 110° C. for at least 10 minutes. The dry thickness of the charge transport layers in this Example was about 25–30 micrometers as determined with a type DS No. 11033 Permascope.

The completed devices generally contained the following:

Substrate: Polyvinyl fluoride (corona treated Tedlar).

Conductive Layer: 15 wt. % conductive carbon black (BP-2000, available from Cabot Corp.) in HEMA-MAGME copolymer (67:33 molar ratio in polymer as prepared in Example I) with varying p-TSA loadings.

Blocking Layer (BL): HEMA or HEMA-MAGME (67:33 molar ratio in polymer as prepared in Example I) with varying p-TSA loadings.

Adhesive Layer (AL): 0.06 micrometer estimated thickness of P(4VPy)

Charge generator Layer: doped trigonal selenium particles with polyvinylcarbazole and N,N'-bis-(3''-methylphenyl)-[1,1'-biphenyl]-4,4'-diamine.

Charge Transport Layer: N,N'-bis(3''methylphenyl)-[1,1'biphenyl]-4,4''diamine and polycarbonate resin The completed devices were electrically charge-erase cycled using either an ambient scanner or an environmental scanner which are described below.

The ambient cyclic scanner used to obtain the charge-erase cycling results, was equipped with a single wire corotron (5 cm wide) set to deposit $9\times10^{-8}$ coulombs/cm$^2$ of charge on the surface of these experimental devices. The devices were grounded to an aluminum drum having a 76.5 cm circumference and the drum was rotated at a speed of 12 rpm giving a surface speed of 6 inches per second. The devices were discharged (erased) with a tungsten white light source emitted through a plexiglass light pipe and the intensity of the erase lamp was varied from 2 to 10X the amount of light required to discharge the device down to twice the asymptotic residual voltage. The entire xerographic simulation (charge and erase) was carried out in a light tight enclosure.

The environmental cyclic scanner used to obtain charge-erase cycling results under various environmental conditions, was equipped with a single wire corotron (5 cm wide) set to deposit $9\times10^{-8}$ coulombs/cm$^2$ (or $14\times-10^{-8}$ coulombs/cm$^2$ in some cases) of charge on the surface of these experimental devices. The devices were grounded to an aluminum drum having a 63.1 cm circumference and the drum was rotated at a speed of 20 rpm to produce a surface speed of 8.3 inches per second. The devices were discharged (erased) with a short arc white light source emitted through a fiber optic light pipe. The entire xerographic simulation (charge-erase) was carried out in an environmentally controlled light tight chamber. Ambient RH for all devices charge-erase cycled in this application was between 20 and 35%.

Charge-erase cycling for 200 consecutive cycles was carried out on the completed experimental photoreceptors at ambient RH using the environmental scanner.

CHARGE-ERASE CYLING EVALUATION
(A Study of the p-TSA Loading In The Conductive Layer and Blocking Layer)
Photoreceptor Devices Containing
P(HEMA-MAGME) Blocking Layers
on P(HEMA-MAGME) Conductive Layers

| Device Number | P(HEMA-MAGME)[d] Cond. Layer wt. % Acid Level[c] | Blocking Layer 0.8–1.0 micrometer wt. % Acid Level[c] | Charge-Erase Cyclic Date | | | |
|---|---|---|---|---|---|---|
| | | | $V_{o(1)}$ | $V_{O(200)}$ | $V_{R(3)}$ | $V_{R(200)}$ |
| IIa[a] | A | None | 210 | 195 | 15 | 20 |
| IIb[b] | A | None | 540 | 460 | 20 | 30 |
| IIc | A | P(HEMA)C' | 890 | 930 | 25 | 30 |
| IId | A | P(HEMA-MAGME)C'[d] | 905 | 835 | 34 | 37 |
| IIe | A | P(HEMA-MAGME)A'[d] | 840 | 820 | 25 | 35 |
| IIf | B | P(HEMA-MAGME)C'[d] | 920 | 910 | 28 | 32 |
| IIg | B | P(HEMA-MAGME)A'[d] | 910 | 865 | 22 | 26 |
| IIh | B | P(HEMA-MAGME)B'[d] | 870 | 890 | 25 | 30 |
| IIi | C | P(HEMA-MAGME)C'[d] | 975 | 940 | 33 | 36 |
| IIj | C | P(HEMA-MAGME)A'[d] | 870 | 835 | 35 | 40 |
| IIk | C | P(HEMA-MAGME)B'[d] | 980 | 955 | 31 | 35 |

[a]no blocking layer or adhesive layer
[b]no blocking layer
[c]based on weight of polymer
[d]67:33 molar ratio of HEMA to MAGME repeat units Devices IIa–IIc are controls for the remaining devices in the above table wherein the same generator and transport layer compositions and samples were used. The effect of the absence of a blocking layer and an adhesive layer in device IIa is obvious as low charge acceptance. Addition of the adhesive layer, about 600 angstroms thick of P(4VPy), imparts some hole blocking to device IIb versus IIa as reflected in the increased charge acceptance. However, the charging level is inferior to that obtained for the remaining devices which all contain a P(HEMA) based blocking layer of about 0.8–1.0 micrometer and the aforementioned adhesive layer. Since no significant $V_O$ and $V_R$ differences exist for devices IIc–IIk, it is concluded that the P(HEMA-MAGME) blocking layer is electrically equivalent to P(HEMA) blocking layers of the same thickness and furthermore that the level of cross-linking acid (p-toluenesulfonic acid monohydrate) in the conductive layer and the blocking layer does not impact the charge-erase electrical properties in 200 cycles at ambient (20–35%) RH testing conditions. The absence of an impact on electrical properties by the catalytic levels of acid suggests that at these low acid levels the p-TSA is itself bound by hydrogen bonding to the densely hydrogen bonded P(HEMA) based polymers comprising the conductive and blocking layers and so acid migration into the CGL and/or CTL is precluded. In addition, the slightly basic P(4VPy) adhesive layer most likely functions as a barrier to any p-TSA that may have migrated upward during coating of the CGL and/or CTL. Presumably the P(4VPy) forms a salt with the p-TSA thereby preventing further upward migration of the acid.

Device IIi, which does not contain added acid catalyst in either layer, was cross-linked after heating at 135° C. for one hour. Cross-linking, at the aforementioned drying conditions, was verified when a P(HEMA-MAGME) coating subjected to these drying conditions in the absence of p-TSA failed to redissolve in the original solvent Dowanol PM (1-methoxy-2-hydroxypropane) at a concentration (≦2 weight percent) more dilute than that used in the original conductive and/or blocking layer formulations. Cross-linking of the P(HEMA-MAGME) ground plane itself was substantiated by swabbing the dried (135° C./1 hr.) conductive layer coating with a Dowanol PM moist Q-tip with the result that little or no black color was transferred to the Q-tip versus the same coating heated at less than 100° C. The absence of the need of acid catalysis for cross-linking at 135° C. totally eliminates the possibility of electrically contaminating the CGL and/or CTL with acid.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a supporting substrate, an electrically conductive layer comprising at least a partially cross-linked polymer having a backbone derived from alkyl acrylamidoglycolate alkyl ether, a charge blocking layer comprising a polymer having a backbone derived from alkyl acrylamidoglycolate alkyl ether and at least one photoconductive layer.

2. An electrophotographic imaging member according to claim 1 wherein said alkyl acrylamidoglycolate alkyl ether in said electrically conductive layer is methyl acrylamidoglycolate methyl ether.

3. An electrophotographic imaging member according to claim 1 wherein said backbone in said electrically conductive layer is a homopolymer of alkyl acrylamidoglycolate alkyl ether.

4. An electrophotographic imaging member according to claim 1 wherein said backbone in said electrically conductive layer is a copolymer of alkyl acrylamidoglycolate alkyl ether and a vinyl hydroxy ester or vinyl hydroxy amide.

5. An electrophotographic imaging member according to claim 1 wherein said electrically conductive layer comprises conductive particles dispersed in a cross-linked polymer having a backbone derived from alkyl acrylamidoglycolate alkyl ether.

6. An electrophotographic imaging member according to claim 1 wherein said electrically conductive layer comprises conductive particles dispersed in a partially cross-linked polymer having a backbone derived from alkyl acrylamidoglycolate alkyl ether, said polymer being sufficiently cross-linked whereby it is substantially insoluble in solvents applied with said photoconductive layer.

7. An electrophotographic imaging member according to claim 1 wherein said polymer in said blocking layer is cross-linked.

8. An electrophotographic imaging member according to claim 1 wherein said polymer in said blocking layer is an uncross-linked polymer.

9. An electrophotographic imaging member according to claim 1 wherein said backbone in said charge blocking layer is a homopolymer of alkyl acrylamidoglycolate alkyl ether.

10. An electrophotographic imaging member according to claim 1 wherein said polymer in said blocking layer is an uncross-linked homopolymer having a number average molecular weight of at least 20,000.

11. An electrophotographic imaging member according to claim 1 wherein said alkyl acrylamidoglycolate alkyl ether in said charge blocking layer is methyl acrylamidoglycolate methyl ether.

12. An electrophotographic imaging member according to claim 1 wherein said backbone in said charge blocking layer is a copolymer of alkyl acrylamidoglycolate alkyl ether and a vinyl hydroxy ester or vinyl hydroxy amide.

13. An electrophotographic imaging member according to claim 1 wherein said alkyl acrylamidoglycolate alkyl ether is represented by the following formula:

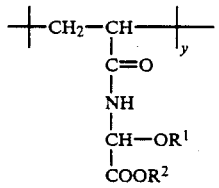

where $R^1$ and $R^2$ are independently selected from lower aliphatic groups containing from 1 to 4 carbon atoms.

14. An electrophotographic imaging member according to claim 1 wherein said backbone in said conductive layer or said blocking layer is derived from said alkyl acrylamidoglycolate alkyl ether copolymerized with a vinyl monomer.

15. An electrophotographic imaging member according to claim 1 wherein prior to any cross-linking said polymer having a backbone derived from alkyl acrylamidoglycolate alkyl ether is represented by the following formula:

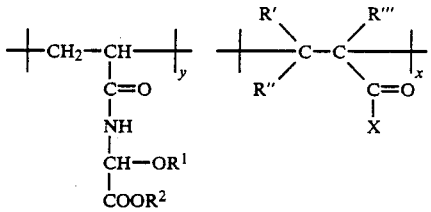

wherein:

$R^1$ and $R^2$ are independently selected from alkyl groups containing from 1 to 4 carbon atoms, y is from 100 mol percent to 1 mol percent, x is from 0 mol percent to 99 mol percent, X is selected from the group consisting of groups represented by the following groups: —O—R—$(OH)_z$, —NH—R—$(OH)_z$, —N—R—R—$(OH)_z$, and

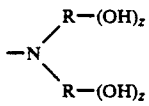

R is selected from the group consisting of aliphatic, aromatic, heteroaliphatic, heteroaromatic, fused aromatic ring and heteroaromatic ring groups containing up to 10 carbon atoms;

z contains from 1 to 10 hydroxyl groups;

R′, R″ and R‴ are independently selected from the group consisting of hydrogen, aliphatic, aromatic, heteroaliphatic, heteroaromatic, fused aromatic ring and heteroaromatic ring groups containing up to 10 carbon atoms.

16. An electrophotographic imaging member according to claim 15 wherein y is between about 33 and about 90 mol percent and x between about 67 and about 10 mol percent.

17. An electrophotographic imaging member according to claim 16 wherein y is between about 33 and about 67 mol percent and x is between about 67 and about 33 mol percent.

18. A process for fabricating an electrophotographic imaging member comprising providing a supporting substrate, applying an electrically conductive layer coating composition comprising at least a solution of a substantially uncross-linked polymer having a backbone derived from alkyl acrylamidoglycolate alkyl ether on said supporting substrate, heating said electrically conductive layer coating composition to at least partially cross-link said backbone and form a dried electrically conductive layer, applying a charge blocking layer coating composition comprising at least a solution of a substantially uncross-linked polymer having a backbone derived from alkyl acylamidoglycolate alkyl ether on said dried electrically conductive layer, heating said charge blocking layer coating composition to form a dried charge blocking layer, and applying at least one photoconductive layer composition comprising a solvent in which components of said dried electrically conductive layer and dried charge blocking layer are substantially insoluble.

19. A process for fabricating an electrophotographic imaging member according to claim 18 wherein said substantially uncross-linked polymer in said conductive layer coating composition has a number average molecule weight of at least about 2,000.

20. An imaging process comprising providing an electrophotographic imaging member comprising a supporting substrate, an electrically conductive layer comprising at least a partially cross-linked polymer having a backbone derived from alkyl acrylamidoglycolate alkyl ether, a charge blocking layer comprising a polymer having a backbone derived from alkyl acrylamidoglycolate alkyl ether and at least one photoconductive layer, forming a uniform electrostatic charge to said photoconductive layer, exposing said photoconductive layer to activating electromagnetic radiation in image configuration to form an electrostatic latent image, depositing toner particles to form a toner image in conformance to said electrostatic latent image, and transfering said toner image to a receiving member.

* * * * *